US008020544B2

(12) United States Patent
McPherson et al.

(10) Patent No.: US 8,020,544 B2
(45) Date of Patent: Sep. 20, 2011

(54) ARCHERY BOW WITH FORCE VECTORING ANCHOR

(76) Inventors: Mathew A. McPherson, Norwalk, WI (US); Gary L. Simonds, Gainesville, FL (US)

( * ) Notice: Subject to any disclaimer, the term of this patent is extended or adjusted under 35 U.S.C. 154(b) by 401 days.

(21) Appl. No.: 12/248,467

(22) Filed: Oct. 9, 2008

(65) Prior Publication Data

US 2010/0089375 A1 Apr. 15, 2010

(51) Int. Cl.
*F41B 5/00* (2006.01)
*F41B 5/10* (2006.01)

(52) U.S. Cl. ..... 124/25.6; 124/23.1; 124/86

(58) Field of Classification Search ..... 124/23.1, 124/25.6, 86
See application file for complete search history.

(56) References Cited

U.S. PATENT DOCUMENTS

| | | | | | |
|---|---|---|---|---|---|
| 3,990,425 | A | | 11/1976 | Ketchum | |
| 4,337,749 | A | * | 7/1982 | Barna | 124/25.6 |
| 4,338,910 | A | | 7/1982 | Darlington | |
| 4,440,142 | A | * | 4/1984 | Simonds | 124/25.6 |
| 4,461,267 | A | | 7/1984 | Simonds et al. | |
| 4,515,142 | A | | 5/1985 | Nurney | |
| 4,519,374 | A | | 5/1985 | Miller | |
| 4,660,536 | A | * | 4/1987 | McPherson | 124/25.6 |
| 4,774,927 | A | * | 10/1988 | Larson | 124/25.6 |
| 4,926,833 | A | * | 5/1990 | Darlington | 124/23.1 |
| 4,967,721 | A | | 11/1990 | Larson | |
| 5,211,155 | A | * | 5/1993 | Zamojski | 124/25.6 |
| 5,368,006 | A | | 11/1994 | McPherson | |
| 5,381,777 | A | * | 1/1995 | Mitchell et al. | 124/25.6 |
| 5,505,185 | A | | 4/1996 | Miller | |
| 5,678,529 | A | | 10/1997 | Larson | |
| 5,782,229 | A | * | 7/1998 | Evans et al. | 124/25.6 |
| 5,791,323 | A | * | 8/1998 | Dunlap | 124/25.6 |
| 5,890,480 | A | * | 4/1999 | McPherson | 124/25.6 |
| 5,934,265 | A | | 8/1999 | Darlington | |
| 5,960,778 | A | | 10/1999 | Larson | |
| 6,035,840 | A | | 3/2000 | McPherson | |
| 6,082,347 | A | | 7/2000 | Darlington | |
| 6,112,732 | A | * | 9/2000 | Larson | 124/25.6 |
| 6,247,466 | B1 | * | 6/2001 | McPherson | 124/25.6 |
| 6,443,139 | B1 | * | 9/2002 | McPherson | 124/25.6 |
| 6,516,790 | B1 | | 2/2003 | Darlington | |
| 6,666,202 | B1 | | 12/2003 | Darlington | |
| 6,688,295 | B1 | | 2/2004 | Miller | |
| 6,792,930 | B1 | * | 9/2004 | Kronengold et al. | 124/25.6 |
| 6,990,970 | B1 | | 1/2006 | Darlington | |
| 6,994,079 | B1 | | 2/2006 | Darlington | |
| 7,047,958 | B1 | | 5/2006 | Colley | |
| 7,188,615 | B2 | * | 3/2007 | Chang | 124/25.6 |
| 7,305,979 | B1 | * | 12/2007 | Yehle | 124/25.6 |
| 7,441,555 | B1 | | 10/2008 | Larson | |
| 2008/0135032 | A1 | | 6/2008 | Islas | |
| 2009/0000607 | A1 | * | 1/2009 | Miller | 124/25.6 |

* cited by examiner

*Primary Examiner* — Alvin Hunter
*Assistant Examiner* — Scott Young
(74) *Attorney, Agent, or Firm* — Vidas, Arrett & Steinkraus, P.A.

(57) ABSTRACT

In some embodiments, an archery bow comprises a rotatable member configured for rotation about a first rotatable member axis. A cable anchor is attached to the rotatable member and rotatable with respect to the rotatable member about an anchor axis. The anchor axis is offset from the rotatable member axis. The bow can further comprise a power cable anchored to said cable anchor.

21 Claims, 34 Drawing Sheets

ARCHERY BOW WITH FORCE VECTORING ANCHOR

BACKGROUND OF THE INVENTION

This invention relates generally to archery bows and more specifically to compound archery bows and rotatable members used in compound archery bows.

Compound archery bows are known in the art. Various configurations have included single cam designs, modified single cam designs and two cam designs. Each configuration can be better than other configurations in some ways, and less desirable in others. For example, it is possible for some two cam bows to launch an arrow faster than a single cam design; however, rotation of the two cams must be synchronized for optimum performance. Two cam bows have a tendency to fall out of sync, wherein the bow can experience a loss in arrow launch speed and will require maintenance to adjust cam timing. Two cam bows often generate more vibration, noise and reverberations as an arrow is launched. While a single cam bow may not shoot as fast as some two cam bows, a single cam bow will often be more pleasurable to use and will require significantly less maintenance over its life span.

In an attempt to solve timing issues in two cam bows, some designs use cables to directly link the cams to one another, forcing them to rotate together. Although such configurations can be more desirable than older designs, the direct mechanical linkage does have drawbacks, such as increased friction between the moving parts, causing losses in the total energy transferred to an arrow at launch.

There remains a need for novel archery bow designs capable of increased mechanical efficiency and subsequent arrow launch speed while also being more pleasurable for an archer to use, and requiring less maintenance.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72.. The abstract is not intended to be used for interpreting the scope of the claims.

BRIEF SUMMARY OF THE INVENTION

In some embodiments, an archery bow comprises a first rotatable member being rotatable about a first rotatable member axis. A first power cable anchor is attached to the first rotatable member and rotatable with respect to the first rotatable member about a first anchor axis. The first anchor axis is offset from the first rotatable member axis. A first power cable can be anchored to said first power cable anchor.

In some embodiments, the archery bow further comprises a second rotatable member that is rotatable about a second rotatable member axis. The first power cable can be anchored to the second rotatable member.

In some embodiments, the second rotatable member comprises a second power cable anchor that is rotatable with respect to the main body of the second rotatable member about a second anchor axis. The second anchor axis is offset from the second rotatable member axis. A second power cable can be anchored to said second power cable anchor.

In some embodiments, a rotatable member for use with a compound archery bow comprises a body configured for rotation about a rotatable member axis and a cable anchor. The cable anchor is attached to the body and rotatable with respect to said body about an anchor axis, wherein the anchor axis is offset from the rotatable member axis.

In some embodiments, a rotatable member for use with a compound archery bow comprises a body configured for rotation about a rotatable member axis and a module configured for attachment to the body. The module comprises a cable anchor that is rotatable with respect to the module about an anchor axis, wherein the anchor axis offset from the rotatable member axis.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
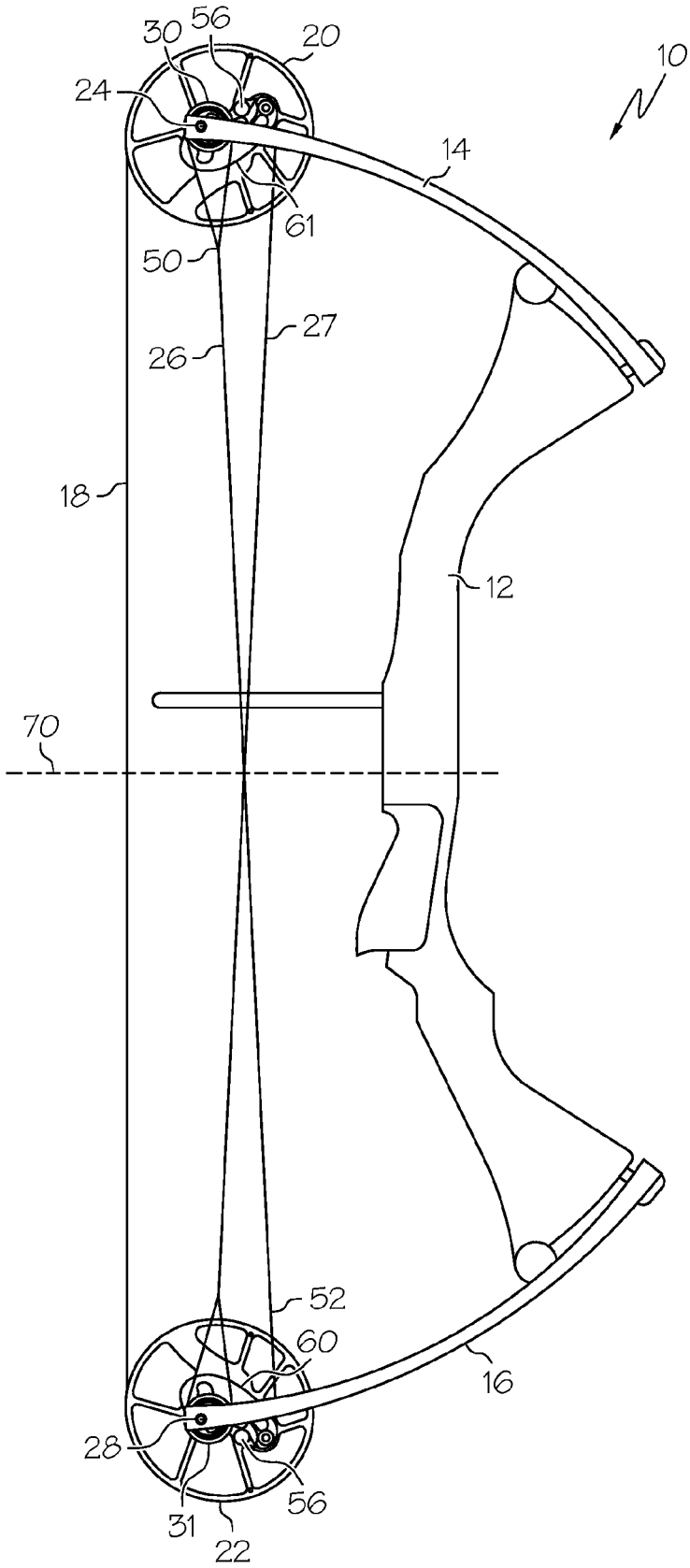
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the Figures shall refer to like features unless otherwise indicated.

"Archery bow" as used herein is intended to encompass any suitable type of compound archery bow, including single cam bows, CPS bows and/or cam-and-a-half bows, dual cam and/or twin cam bows, crossbows, etc.

FIG. 1 shows an embodiment of an archery bow 10 comprising a force vectoring anchor 30. The vectoring anchor 30 generally allows a force vector applied by a cable 26 to transition with respect to a support point (e.g. an axle 24) as the bow is drawn.

An archery bow 10 can generally comprise a handle 12, a first limb 14 and a second limb 16. Each limb 14, 16 can be attached to an end of the handle. Each limb 14, 16 further supports a respective rotatable member 20, 22. For example, a first rotatable member 20 can be rotatably supported by a first axle 24, which is supported by the first limb 14, and a second rotatable member 22 can be rotatably supported by a second axle 28, which is supported by the second limb 16. Thus, each rotatable member 20, 22 is rotatably attached to the archery bow 10 and configured for rotation about an axis that can be defined, in some embodiments, by the axle (e.g. 24). Each rotatable member 20, 22 can comprise a cam, a pulley or any other suitable rotatable member.

Figure 18:
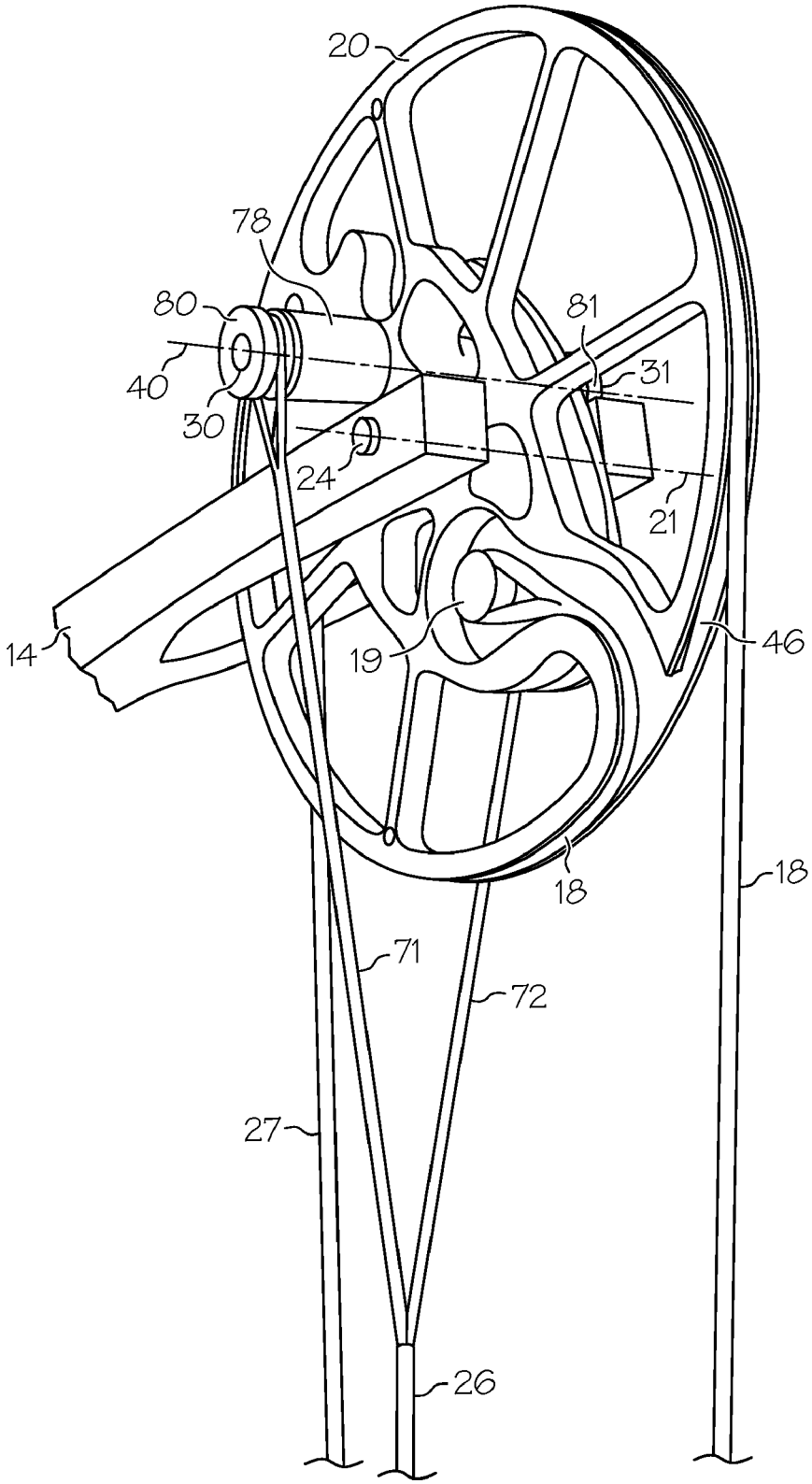
FIG. 18 shows a portion of another embodiment of an archery bow.

The archery bow 10 further comprises a bowstring 18. Each rotatable member 20, 22 can comprise a bowstring groove 46 (see e.g. FIG. 18), which will typically extend around at least a portion of its outer perimeter. The bowstring 18 can extend between the first and second rotatable members 20, 22, and at least a portion of the bowstring 18 can be oriented within the groove 46 of both the first and second rotatable members 20, 22. Thus, the groove 46 can comprise a track that pays out bowstring 18 as the bow is drawn, and takes up bowstring 18 as an arrow is launched. As shown in FIG. 18, in some embodiments, a bowstring 18 can wrap around substantially the entire periphery of a rotatable member 20 in a groove 46 and then anchor to a bowstring anchor 19, such as a post. In some embodiments, the bowstring 18 can anchor similarly to the second rotatable member 22. In some embodiments, for example as shown in FIG. 1, the first rotatable member 20 and the second rotatable member 22 can comprise mirror images of one another, and the bowstring 18 take-up and anchoring mechanisms can be mirror images, for example taken across a mirroring axis 70. A mirroring axis 70 can be orthogonal to a line spanning between the rotatable member supports (e.g. axles 24, 28) and located midway between the supports/axles as shown on FIG. 1.

The archery bow 10 further comprises at least one power cable 26, which can be anchored at one end to a vectoring anchor 30 and can extend to an opposite rotatable member. For example, a power cable 26 can be anchored at a first end 50 to a vectoring anchor 30 associated with the first limb 14 and/or the first rotatable member 20, and a second end 52 can extend to the second rotatable member 22. The power cable 26 can be anchored to the second rotatable member 22, for example attaching to a post 56. At least a portion of the power cable 26 can be oriented in a power cable take-up track 60 associated with the second rotatable member 22. As the bowstring 18 is drawn, power cable 26 can be taken up by the power cable take-up track 60. The specific shape of the power cable take-up track 60 impacts the compounding action of the bow 10.

In some embodiments, for example as shown in FIG. 1, the archery bow 10 can comprise a second power cable 27. The second power cable 27 can be anchored at one end to a second vectoring anchor 31 associated with the second limb 16 and/or the second rotatable member 22, and extend to the first rotatable member 20. The second power cable 27 can be anchored to the first rotatable member 20, for example attaching to a post 56, and at least a portion of the second power cable 27 can be oriented in a second power cable take-up track 61 associated with the first rotatable member 20. In some embodiments, the first power cable take-up track 60 and the second power cable take-up track 61 can comprise mirror images of one another, for example taken across mirroring axis 70. Similarly, the first power cable 26 and second power cable 27 can comprise mirror images of one another, for example taken across mirroring axis 70. Further, the first vectoring anchor 30 and second vectoring anchor 31 can comprise mirror images of one another, for example taken across mirroring axis 70.

Each vectoring anchor 30, 31 can comprise an anchoring structure that is rotatably attached to a rotatable member 20, 22.

Figure 2:
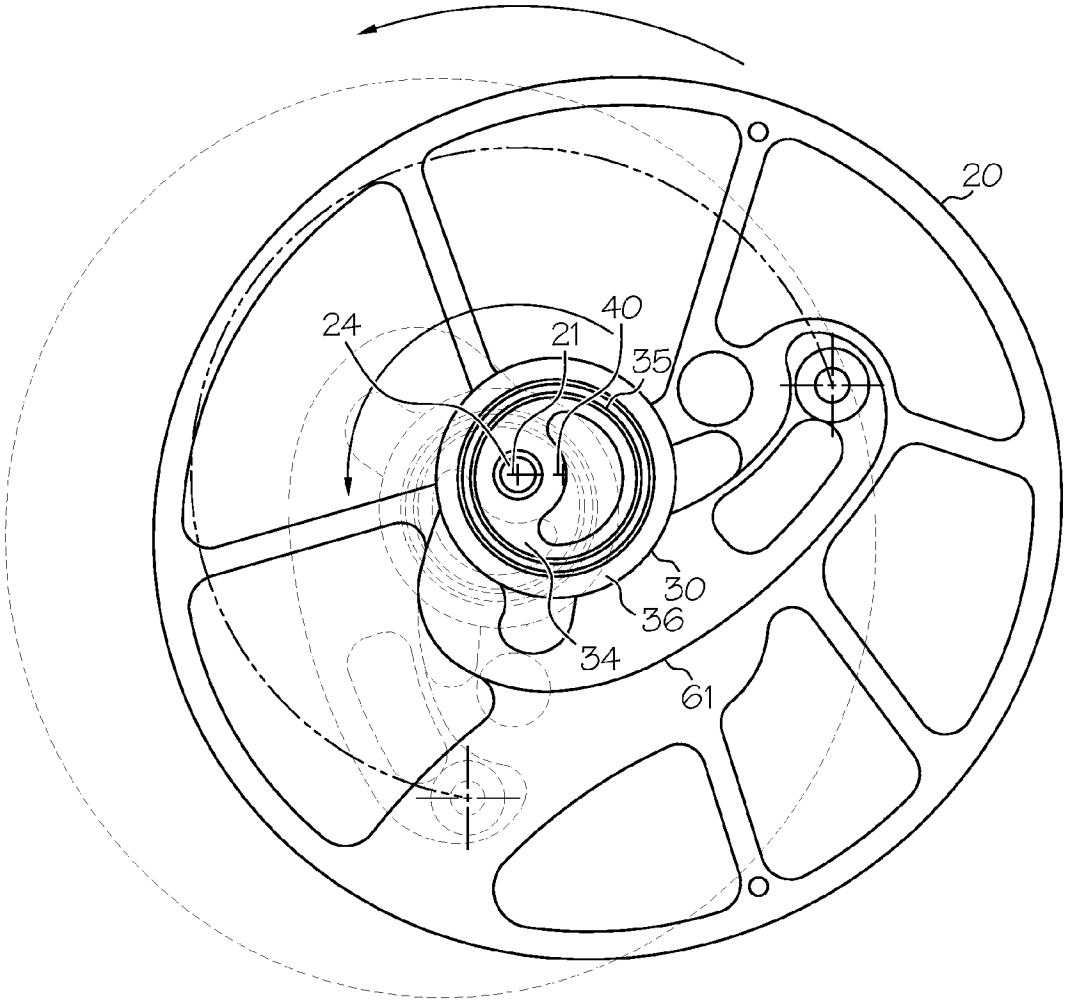
FIG. 2 shows a rotatable member at multiple orientations.

FIG. 2 shows an example of a rotatable member 20 and a vectoring anchor 30 in greater detail. A first orientation is shown in solid lines, and a second orientation is shown in hidden lines. The rotatable member 20 defines a rotatable member axis 21, which the rotatable member 20 rotates about when the bowstring is drawn. The rotatable member axis 21 is preferably an axle 24 associated with a limb 14 (see FIG. 1).

In some embodiments, the vectoring anchor 30 comprises a first portion 34 that is rotatably attached/engaged to a second portion 36. In some embodiments, the first portion 34 can be fixedly attached to the rotatable member 20, and a power cable 26 can be anchored to the second portion 36.

The vectoring anchor 30 defines a center/axis of rotation 40 between the first portion 34 and the second portion 36. The center of rotation 40 is offset from the rotatable member axis 21. Thus, as the rotatable member 20 rotates about the rotatable member axis 21, the center of rotation 40 of the vectoring anchor 30 translocates about the rotatable member axis 21. The translocation allows an effective anchor point (e.g. the center of rotation 40) of the power cable 26, and the force vector applied by the power cable 26, to move as the bow is drawn without requiring that the relevant end of the power cable be taken up on a take-up groove/track. In some embodiments, the axis of rotation 40 is parallel to the rotatable member axis 21. In some embodiments, the center of rotation 40 of the vectoring anchor 30 follows an arcuate path as it translocates about the rotatable member axis 21. In some embodiments, a distance between the center of rotation 40 and the rotatable member axis 21 comprises a radius of the arcuate path.

The vectoring anchor 30 can comprise any suitable type of bearing, such as a plain bearing, a fluid bearing, a magnetic bearing, a needle bearing, a roller bearing, a ball bearing or other rolling element bearing, etc. In some embodiments, each portion 34, 36 of the vectoring anchor 30 can define a substantially circular cross-sectional shape. In some embodiments, one or both portions 34, 36 of the vectoring anchor 30 can be substantially cylindrical in shape.

In some embodiments, the vectoring anchor 30 defines a rotational engagement circumference 35 between the first portion 34 and the second portion 36, and the rotatable member axis 21 is located within the rotational engagement circumference 35. For example, in some embodiments, a rotational engagement circumference 35 can comprise a circumference of a circular bearing, and the rotatable member axis 21 is located within the circumference of the circular bearing. In some embodiments, the first portion 34 of the vectoring anchor 30 defines an outer circumference 35, and the rotatable member axis 21 is located within the outer circumference 35.

In some embodiments, the second portion 36 of the vectoring anchor 30 extends around the outer circumference 35 of the first portion 34. In some embodiments, the second portion 36 comprises a sheave having a track or groove around its outer periphery. At least a portion of the power cable 26 can be oriented in such a track or groove.

Figure 3:
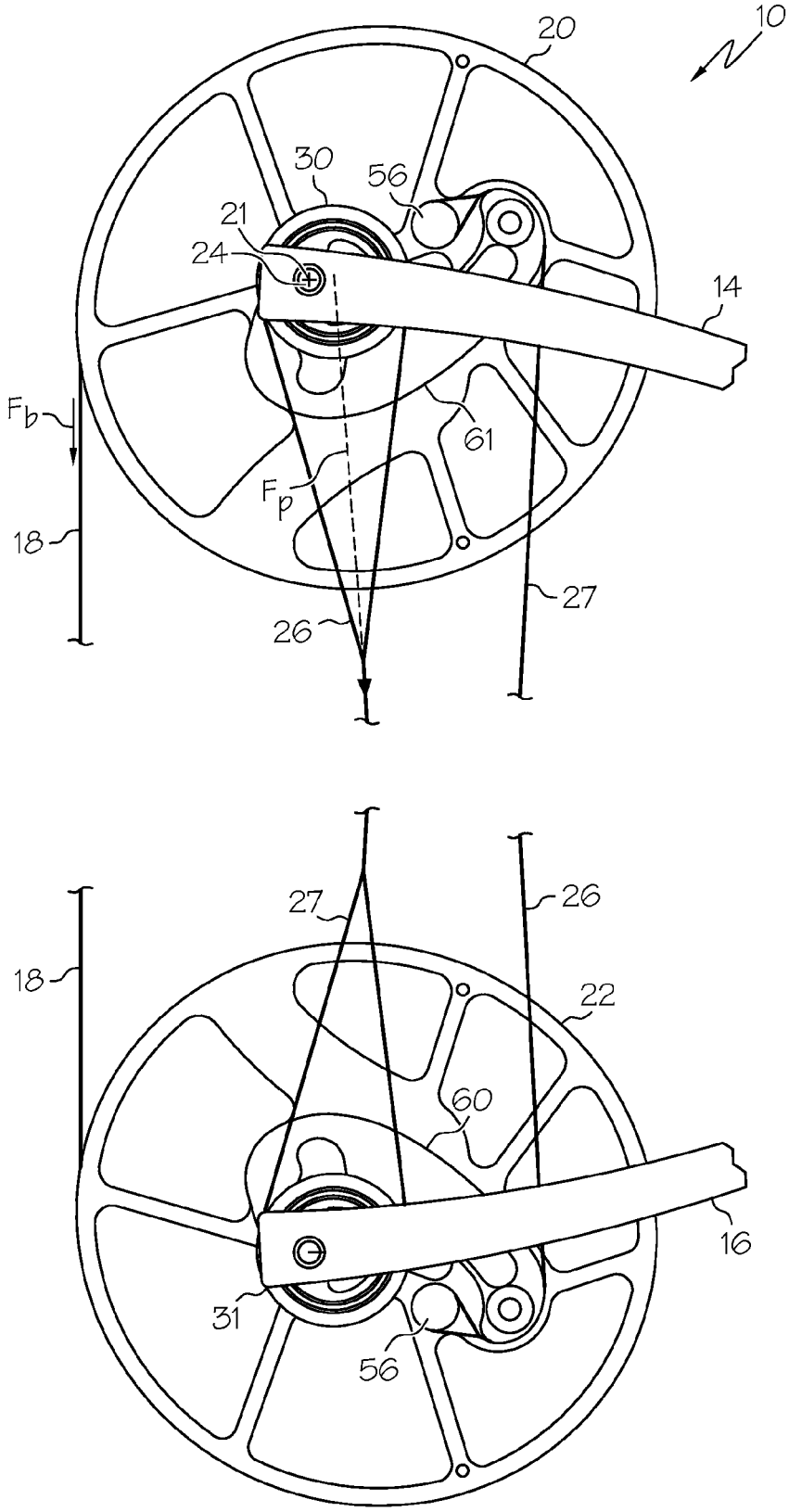
FIGS. 3-5 show an embodiment of upper and lower rotatable members at multiple rotational orientations, such as at-rest, mid-draw and full-draw.
Figure 4:
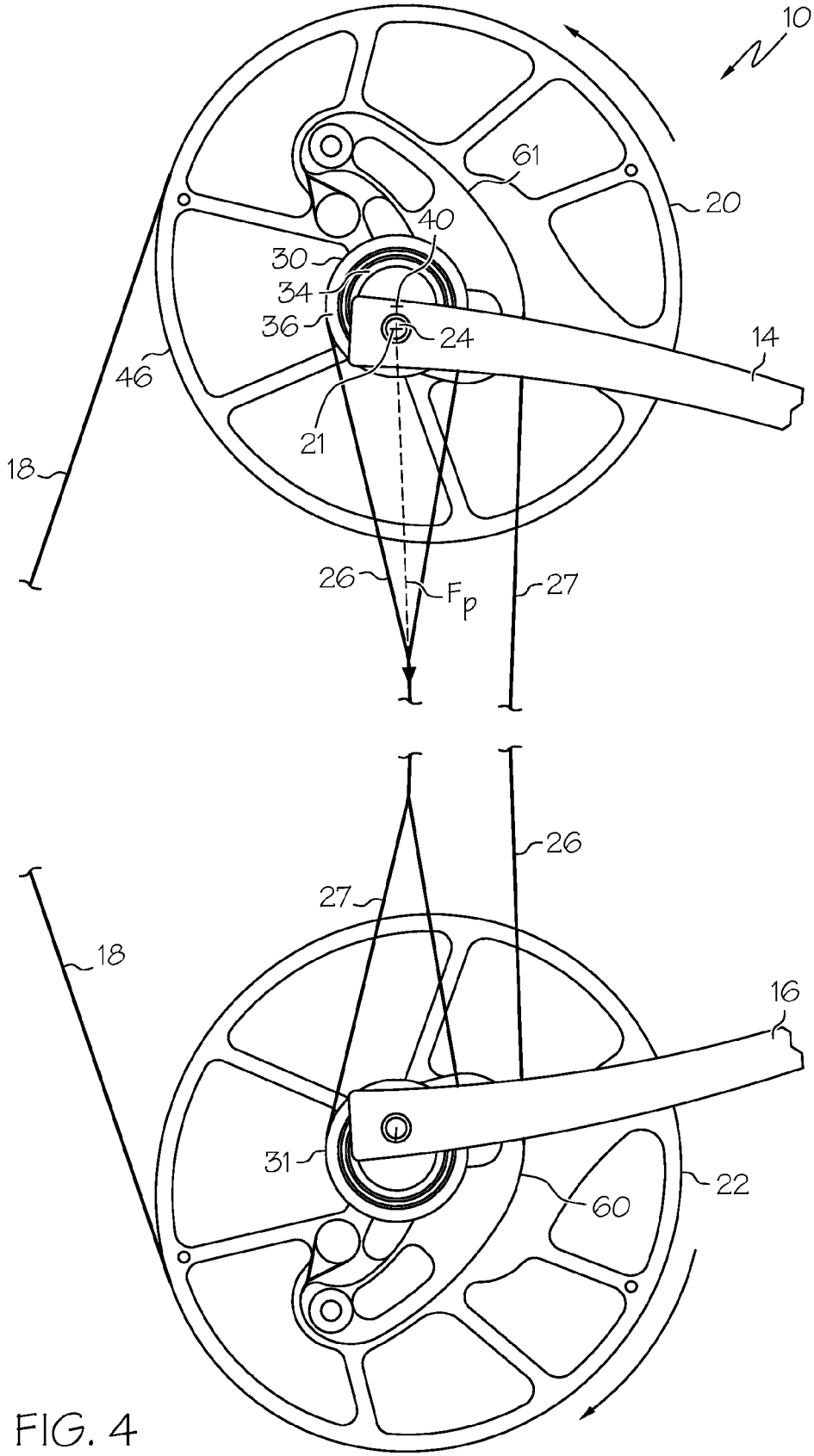
Figure 5:
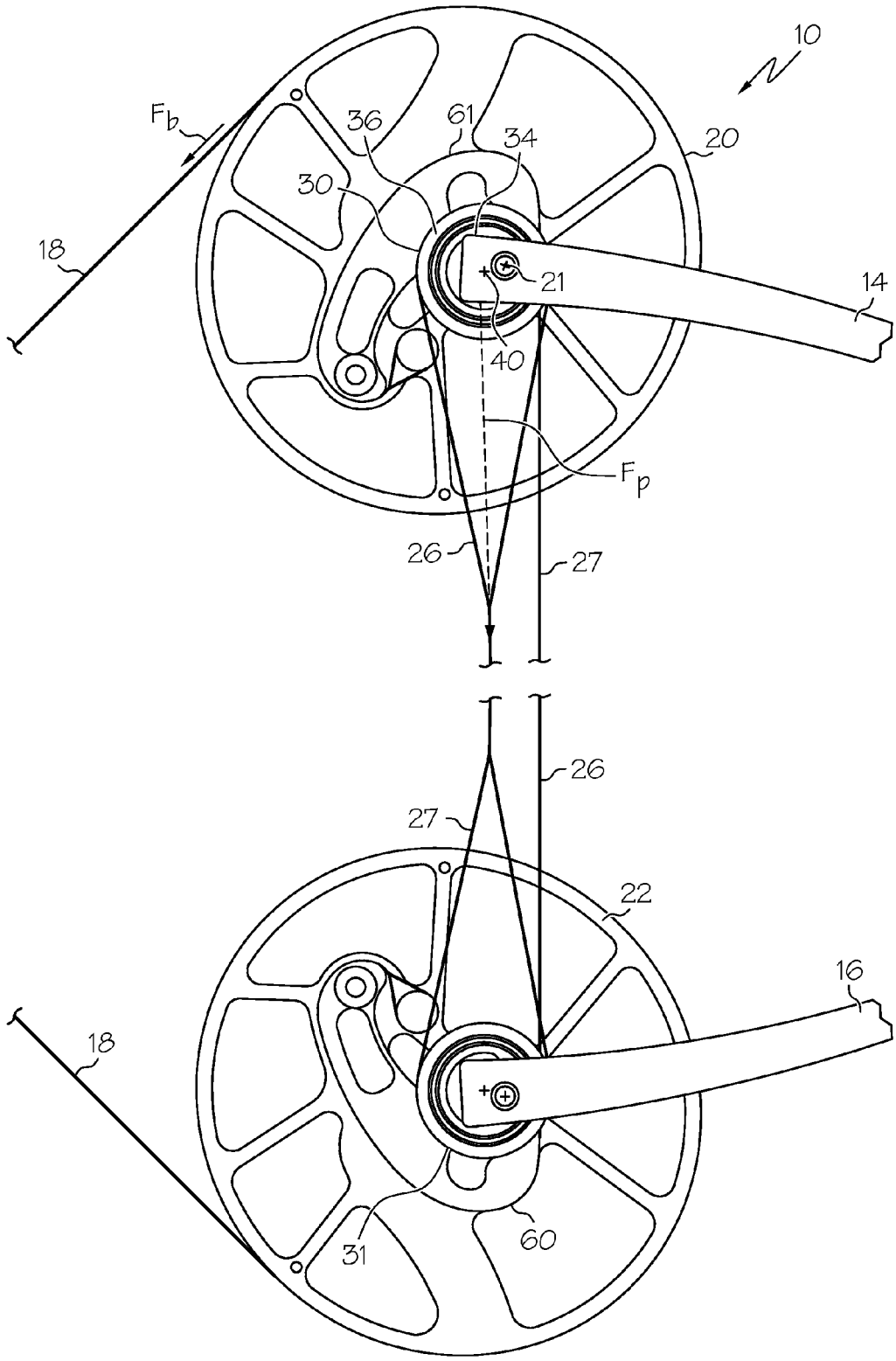

FIGS. 3-5 show an embodiment of rotatable members 20, 22 at three respective draw orientations.

FIG. 3 illustrates a brace or at-rest position. Forces acting upon a rotatable member 20, 22 are discussed with respect to the first or upper rotatable member 20. The bowstring 18, first power cable 26 and second power cable 27 are all under tension. The vectoring anchor 30 can be configured such that a force vector $F_p$ resulting from the first power cable 26 and a force vector $F_b$ resulting from the bowstring 18 are positioned on opposite sides of the rotatable member axis 21 (e.g. the first axle 24). In the embodiment of FIG. 3, the second power cable applies a force vector (not illustrated), which can be located on the same side of the rotatable member axis 21 as the first power cable force vector $F_p$. Each string/cable 18, 26, 27 will apply a moment about the rotatable member axis 21, and the moment in the counterclockwise direction caused by the bowstring force vector $F_b$ is equal to the sum of the two moments in the clockwise direction resulting from the first power cable force vector $F_p$ and the second power cable force vector (not illustrated).

FIG. 4 shows the rotatable members 20, 22 of FIG. 3 oriented at mid-draw. As a user draws back the bowstring 18, the rotatable members 20, 22 rotate appropriately. With respect to the first rotatable member 20, bowstring 18 is let out of the bowstring groove 46 (see also FIG. 18), and the second power cable 27 is taken up on the second power cable take up track 61.

The vectoring anchor 30 allows an effective anchor point of the first power cable 26 to move with respect to the first rotatable member axis 21 (e.g. the first axle 24). The first portion 34 of the vectoring anchor 30 can be fixedly attached to the first rotatable member 20, and can thus rotate with the rotatable member 20. The movement causes the center of rotation 40 of the vectoring anchor 30, and the second portion 36 of the vectoring anchor 30, to translocate with respect to the first rotatable member axis 21. In some embodiments, the center of rotation 40 travels in an arcuate path about the first rotatable member axis 21.

As the center of rotation 40 of the vectoring anchor 30 moves, the location and effect of the first power cable force vector $F_p$ changes. FIG. 4 shows a rotational orientation at which the first power cable force vector $F_p$ passes substantially through the first rotatable member axis 21. Thus, the moment applied to the first rotatable member 20 about the first rotatable member axis 21 by the first power cable force vector $F_p$ at the rotational orientation shown in FIG. 4 is approximately zero. It can be noted that as the archery bow 10 is drawn from the brace position illustrated in FIG. 3 to the mid-draw orientation of FIG. 4, the first power cable force vector $F_p$ moves closer to the first rotatable member axis 21, eventually passing over the first rotatable member axis 21 as shown in FIG. 4. Further, the second portion 36 and center of rotation 40 move farther away from the second rotatable member 22, which effectively works to shorten the length of the first power cable 26. This increases the energy stored in the bow limbs 14, 16, due to additional flexing and axle 24 displacement, and increases tension in the first power cable 26. When an archery bow 10 having a vectoring anchor 30 is compared to a similar bow wherein the power cable anchors directly to an axle (e.g. 24), the bow 10 having the vectoring anchor 30 is able to store more energy per unit of bowstring draw.

FIG. 5 shows the rotatable members 20, 22 of FIGS. 3 and 4 at a full draw orientation. The power cable take-up tracks 60, 61 are shaped to allow "let-off," or a reduction in the force that must be applied to the bowstring 18 to maintain the bow 10 in the fully drawn orientation.

The first portion 34 of the vectoring anchor 30 has continued to move with the first rotatable member 20, which has continued to translocate the second portion 36 and the center of rotation 40. The first power cable force vector $F_p$ has continued to move with respect to the first rotatable member axis 21 and is now positioned on the "bowstring side" of the first rotatable member axis 21. A moment applied to the first rotatable member 20 by the first power cable force vector $F_p$ now works in conjunction with the moment applied by the bowstring force vector $F_b$ and against the moment applied by the second power cable 27. For example, in the first rotatable member 20 of FIG. 5, the bowstring force vector $F_b$ and first power cable force vector $F_p$ each apply a moment in the counterclockwise direction, while the moment caused by the second power cable 27 is in the clockwise direction.

Thus, in some embodiments, the vectoring anchor 30 allows the first power cable force vector $F_p$ to transition from applying a moment to a rotatable member 20 that initially works against the moment applied by the bowstring 18 in the brace orientation (see FIG. 3) to applying a moment that works with the moment applied by the bowstring 18 at full draw (see FIG. 5). In some embodiments, for example in a bow 10 having a second power cable 27, the vectoring anchor 30 allows the first power cable force vector $F_p$ to transition from applying a moment to a rotatable member 20 that initially works with the moment applied by the second power cable 27 in the brace orientation (see FIG. 3) to applying a moment that works against the moment applied by second power cable 27 at full draw (see FIG. 5).

As previously discussed, the second rotatable member 22 and second vectoring anchor 31 can comprise a mirror image of the first rotatable member 20 and first vectoring anchor 30. When the bow 10 comprises a twin cam bow, the vectoring anchors 30, 31 help maintain the rotatable members 20, 22 in alignment without providing a direct mechanical cable connection between the rotatable members 20, 22, for example as might be found in a binary cam bow The vectoring anchor(s) 30, 31 are components of a direct feedback system that allows the rotatable members 20, 22 to be self-aligning. The system can mitigate a potential imbalance that could result if the rotatable members 20, 22 fail to stay rotationally synchronized.

Although FIGS. 3-5 show first and second vectoring anchors 30, 31 and first and second power cable take-up tracks 60, 61 to one side of the rotatable members 20, 22, these elements can be distributed on different sides of the rotatable members 20, 22. For example, in some embodiments, a first vectoring anchor 30, first power cable take-up track 60 and first power cable 26 can be located to a first side of the rotatable members 20, 22 (e.g. behind the rotatable members 20, 22 as shown in FIG. 3), and a second vectoring anchor 31, second power cable take-up track 61 and second power cable 27 can be located to a second side of the rotatable members 20, 22 (e.g. in front of the rotatable members 20, 22 as shown in FIG. 3). In some embodiments, a first vectoring anchor 30 can be located to a first side of a first rotatable member 20, and a first power cable take-up track 60 can be located to a second side of a second rotatable member 22. The first power cable 26 can span between the first vectoring anchor 30 and first power cable take-up track 60 accordingly, crossing from the first side to the second side. A second vectoring anchor 31 can be located to a first side of the second rotatable member 22, and a second power cable take-up track 61 can be located to the second side of the first rotatable member 20. The second power cable 27 can cross from the first side to the second side.

Figure 6:
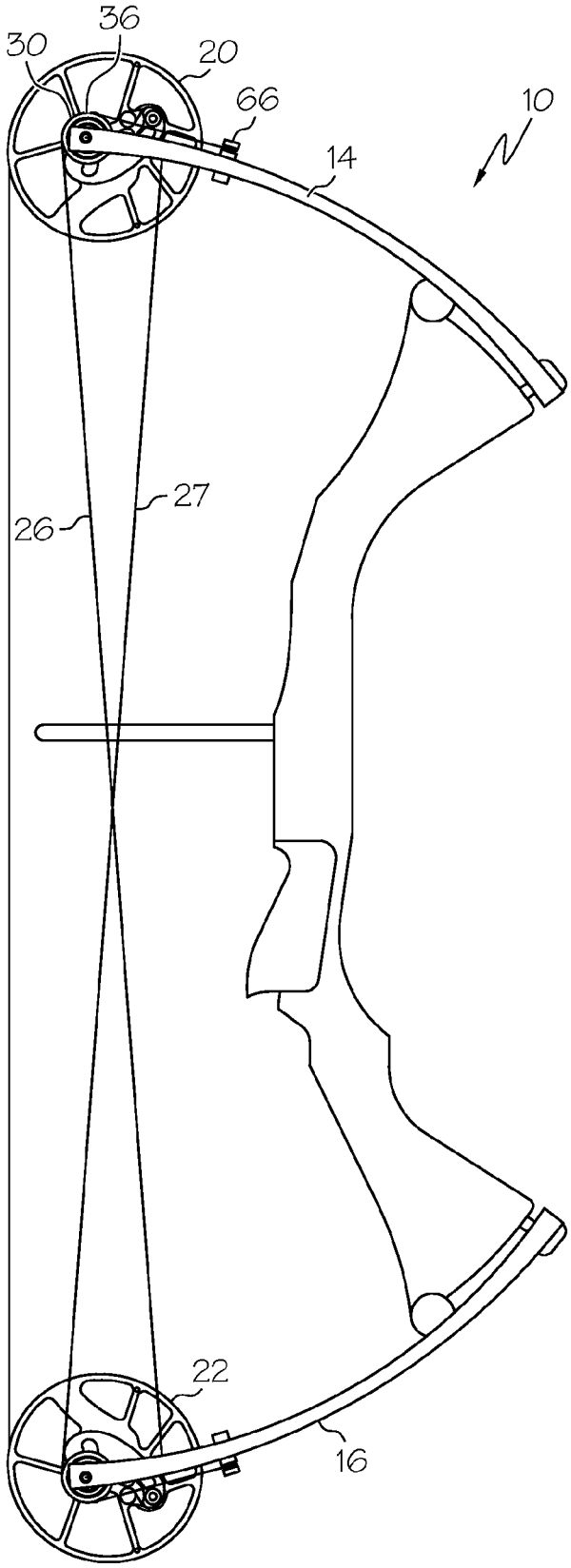
FIGS. 6-9 each show an embodiment of an archery bow.
Figure 7:
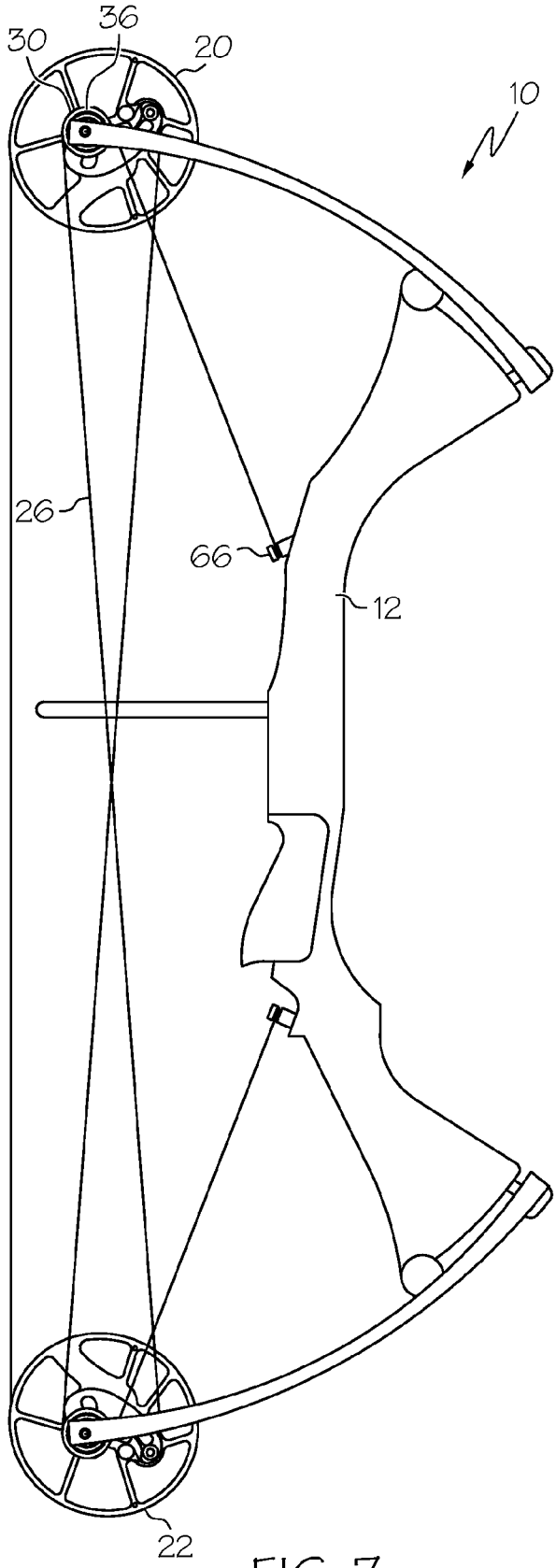
Figure 8:
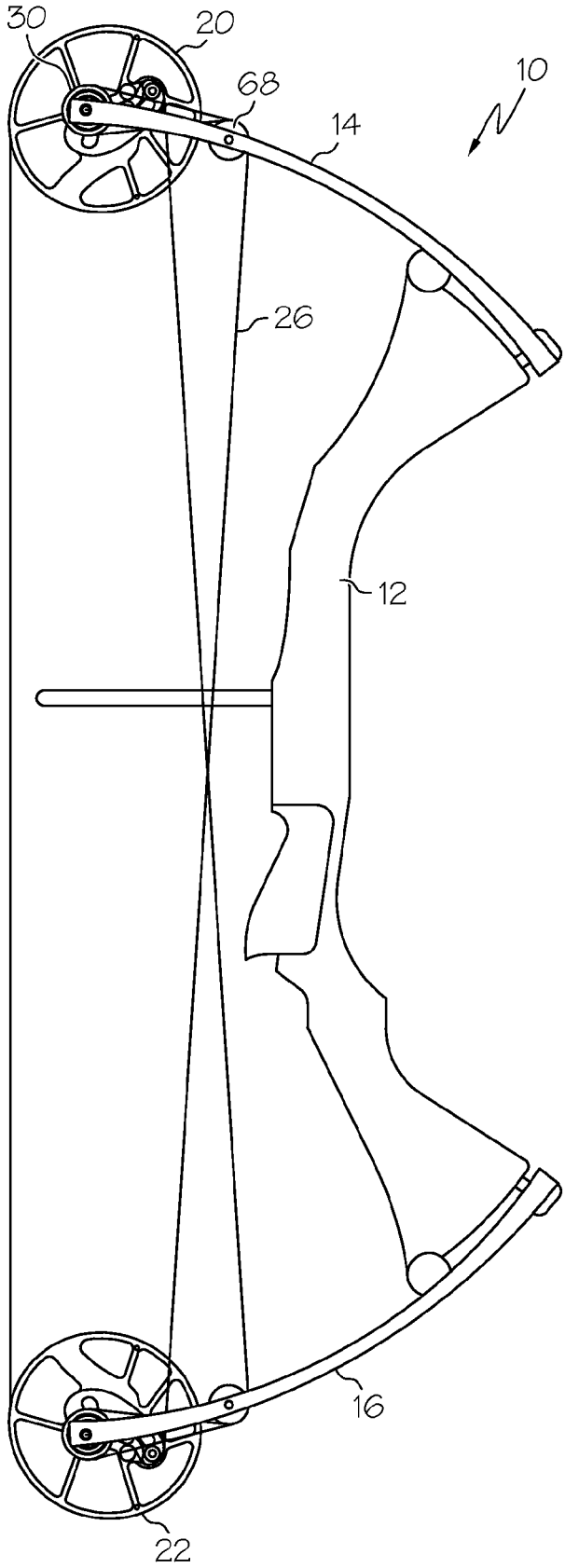

FIG. 6-8 illustrate additional embodiments of an archery bow 10 comprising a vectoring anchor 30. These Figures show that the vectoring anchor 30 is suitable for use with many power cable configurations, and that certain specifics of the bow 10 can be adjusted without departing from the concept of a vectoring anchor 30. Most elements of FIGS. 6 and 7 are similar to FIG. 1; however, FIGS. 6 and 7 show alternative termination configurations for the power cable(s) 26, 27. The first power cable 26 can attach to the second rotatable member 22, extend upwardly and wrap around the second portion 36 of the first vectoring anchor 30 and connect to another portion of the bow 10. FIG. 6 shows a power cable 26 attaching to a post 66 that is attached to a limb 14. FIG. 7 shows a power cable 26 attaching to a post 66 that is attached to the handle 12. In both FIGS. 6 and 7, the second power cable 27 can be a mirror image of the first power cable 26, and the termination mechanism can be similarly mirrored. Most elements of FIG. 8 are similar to FIG. 1; however, FIG. 8 shows an alternative routing configuration for the power cable (s) 26, 27. The first power cable 26 can attach to the second rotatable member 22, extend upwardly and wrap around a pulley 68 and then be anchored to the vectoring anchor 30. Although the pulley 68 is shown attached to a limb 14, it could also be attached to other portions of the bow 10, such as the handle 12.

In another embodiment (not illustrated), referring to FIGS. 1 and 2, it is not necessary for the vectoring anchor 30 to be rotatable with respect to the rotatable member 20. For example, in some embodiments, the vectoring anchor 30 can be fixedly attached to the rotatable member 20. The power cable 26 can be rotatable with respect to the vectoring anchor 30 about a center of rotation 40, for example being configured to slide or slip with respect to the vectoring anchor 30 as the bow is drawn. As such, the vectoring anchor 30 need not comprise first and second portions 34, 36 rotatable with respect to one another as previously described. Thus, in some embodiments, the structure previously described first and second portions 34, 36 can be fixedly attached to one another, comprising a unitary structure. The vectoring anchor 30 will then rotate with the rotatable member 30. In some embodiments, the vectoring anchor 30 can comprise a material conducive to allowing rotation between the power cable 26 and the vectoring anchor 30. For example, one or more surfaces of the vectoring anchor 30 that contact the power cable 26 can comprise a low friction material, such as a ceramic material or a thermoplastic material such as nylon, high-density polyethylene, polytetrefluoroethylene or the like. In some embodiments, a body of a rotatable member 20 can comprise a first material and a contacting surface of a vectoring anchor 30 can comprise a second material having a lower coefficient of friction. In some embodiments, a lubricant can be used between the power cable 26 and vectoring anchor 30, such as oil or a non-liquid such as graphite, molybdenum disulfide, tungsten disulfide or the like. The analysis of moment forces applied to the rotatable member 20, described above with respect to FIGS. 3-5, will be substantially the same for a vectoring anchor 30 that is fixedly attached to the rotatable member 20 and a power cable 26 configured to rotate with respect to the vectoring anchor 30.

Any suitable embodiment described herein as having a vectoring anchor 30 comprising first and second portions 34, 36 rotatable with respect to one another can alternatively comprise a vectoring anchor 30 that is fixedly attached to a rotatable member 20 and a power cable 26 that is rotatable with respect to the vectoring anchor 30.

Figure 9:
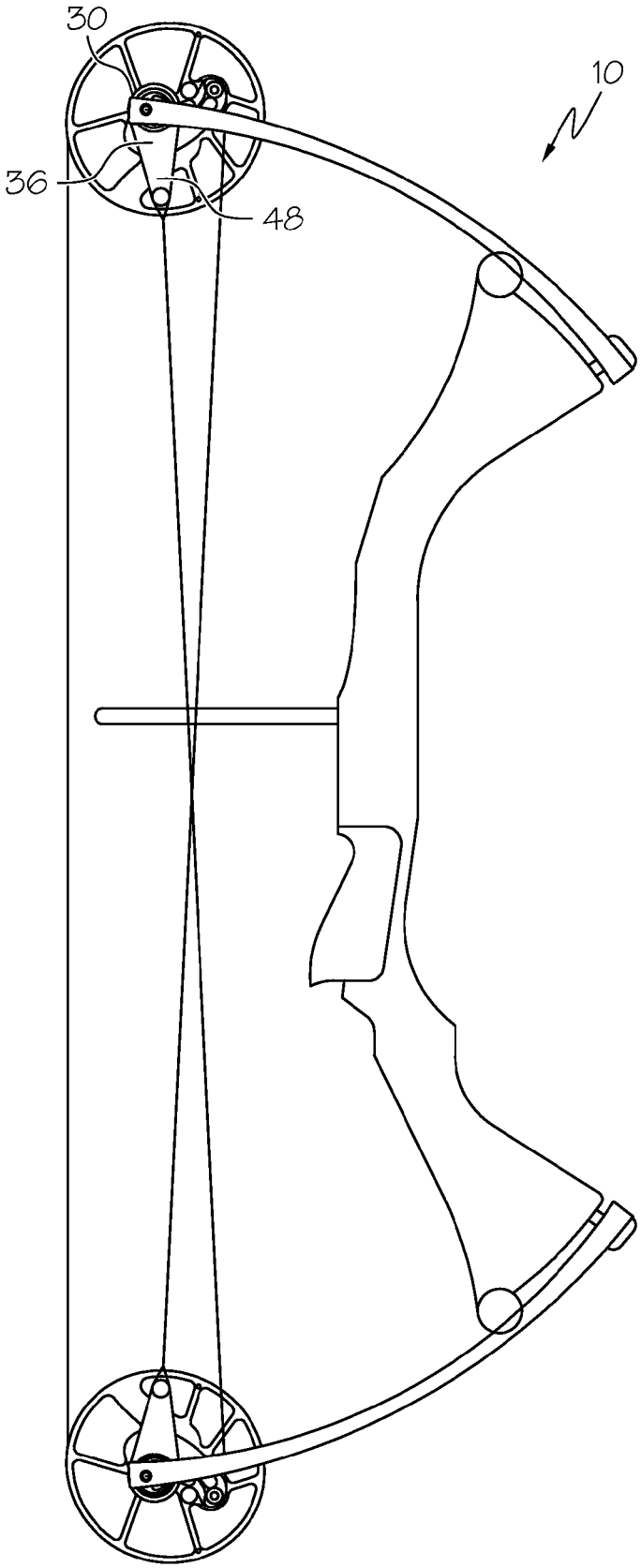

FIG. 9 shows a bow 10 comprising another embodiment of a vectoring anchor 30. Most elements of FIG. 9 are similar to FIG. 1; however, FIG. 9 shows an alternative configuration for the second portion 36 of the vectoring anchor 30. In some embodiments, the vectoring anchor 30 comprises an extension member 48 such as a plate. In some embodiment, the plate 48 comprises the second portion 36 of the vectoring anchor 30.

Figure 10:
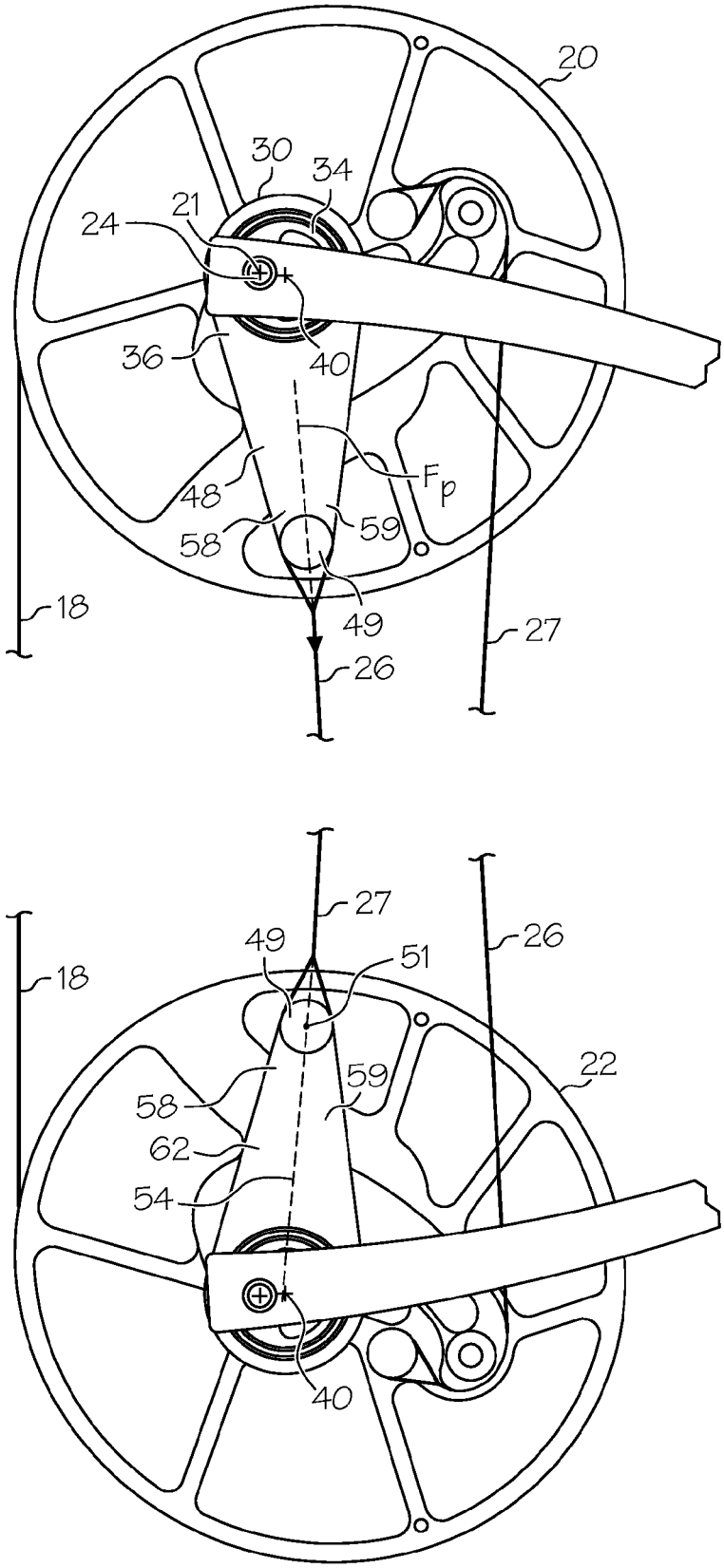
FIGS. 10-12 show another embodiment of upper and lower rotatable members at various rotational orientations, such as at-rest, mid-draw and full-draw.

FIG. 10 shows the rotatable members 20, 22 of FIG. 9 in greater detail. A first portion 34 of the vectoring anchor 30 can be fixedly attached to the rotatable member 20. The first portion 34 can be rotatably attached/engaged to the second portion 36/plate 48. The plate 48 extends around the first portion 34 similar to the second portion 36 shown in FIGS. 3-6, and further extends away from the first portion 34. The plate 48 comprises an anchoring mechanism 49, such as a post, to which the first power cable 26 can be anchored. Any suitable anchoring mechanism 49 can be used. For example, when the anchoring mechanism 49 comprises a post or protrusion, a portion of the power cable 26 can extend around the protrusion. In some embodiments, an anchoring mechanism 49 can comprise an aperture in the plate 48, and the power cable 26 can be tied through the aperture. In some embodiments, an anchoring mechanism 49 can comprise a slot or groove in the plate 48, and the power cable 26 can be anchored to a spool that engages the slot or groove. The plate 48 with anchoring mechanism 49 allows for better serviceability of the archery bow 10, as the power cable 26 can be attached and detached without removal of a rotatable member 20, axle 24, etc.

As shown in FIG. 10, the plate 48 comprises an extension member that is rigid and capable of transferring tensile and compressive forces. Thus, in some embodiments, a plate 48 comprises a rigid extension member. In some other embodiments (not shown), an alternate extension member 48 could be used that would be considered to transmit only tensile forces. For example, a plate 48 of FIG. 10 could be substituted with a tension member such as a loop of wire, cable, etc., attached between the second portion 36 of the vectoring anchor 30 and the power cable 26.

The rotational interaction between the first portion 34 and second portion 36/plate 48 can be similar to the embodiment shown in FIG. 3-6. Thus, a center of rotation 40 between the first portion 34 and the plate 48 can be located within an outer circumference 35 of the first portion 34. The rotatable member axis 21 can be located within the outer circumference 35, and the center of rotation 40 can be offset from the rotatable member axis 21.

The plate 48 can further be shaped to be symmetrical across the power cable force vector $F_p$. Thus, a first half 58 of the plate 48 can be a mirror image of a second half 59 taken across the power cable force vector $F_p$. In some embodiments, a plate axis 62 can extend between the center of rotation 40 and an axis 51 of the anchoring member 49. A centroid 54 of the plate 48 can also be located on the plate axis 62, and the first half 58 of the plate 48 can be a mirror image of the second half 59 taken across the plate axis 62. In some other embodiments, a plate 48 can be asymmetrical across the power cable force vector $F_p$, for example as discussed below with respect to FIG. 15.

FIG. 10 shows an example of rotatable members 20, 22 in the brace condition. Forces acting upon the rotatable members 20, 22 are similar to the forces described with respect to FIG. 3. The first power cable force vector $F_p$ applies a moment to the first rotatable member 20 about the first rotatable member axis 21 that acts in conjunction with a moment applied by the second power cable 27, and against a moment applied by the bowstring 18.

Figure 11:
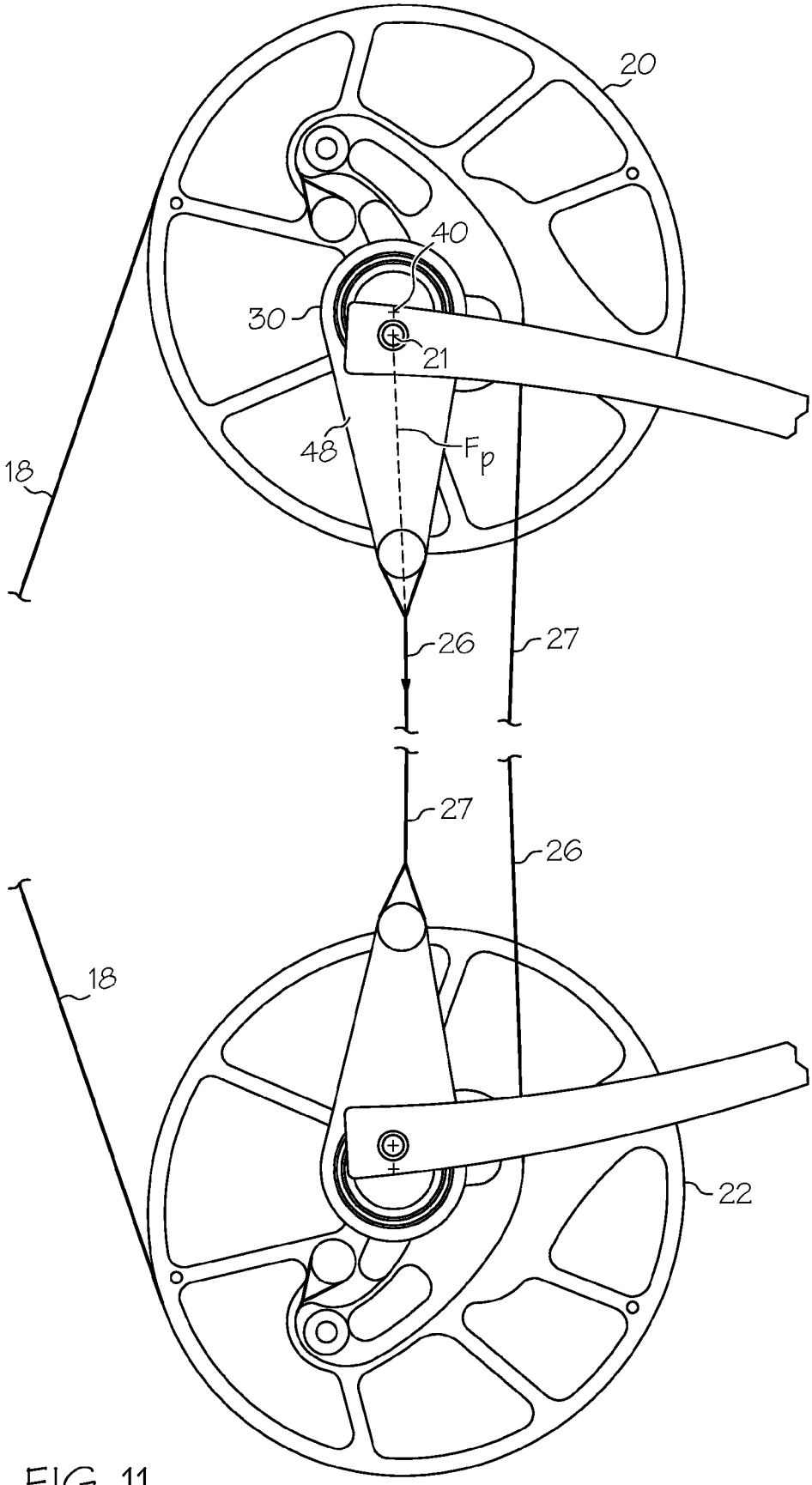
Figure 12:
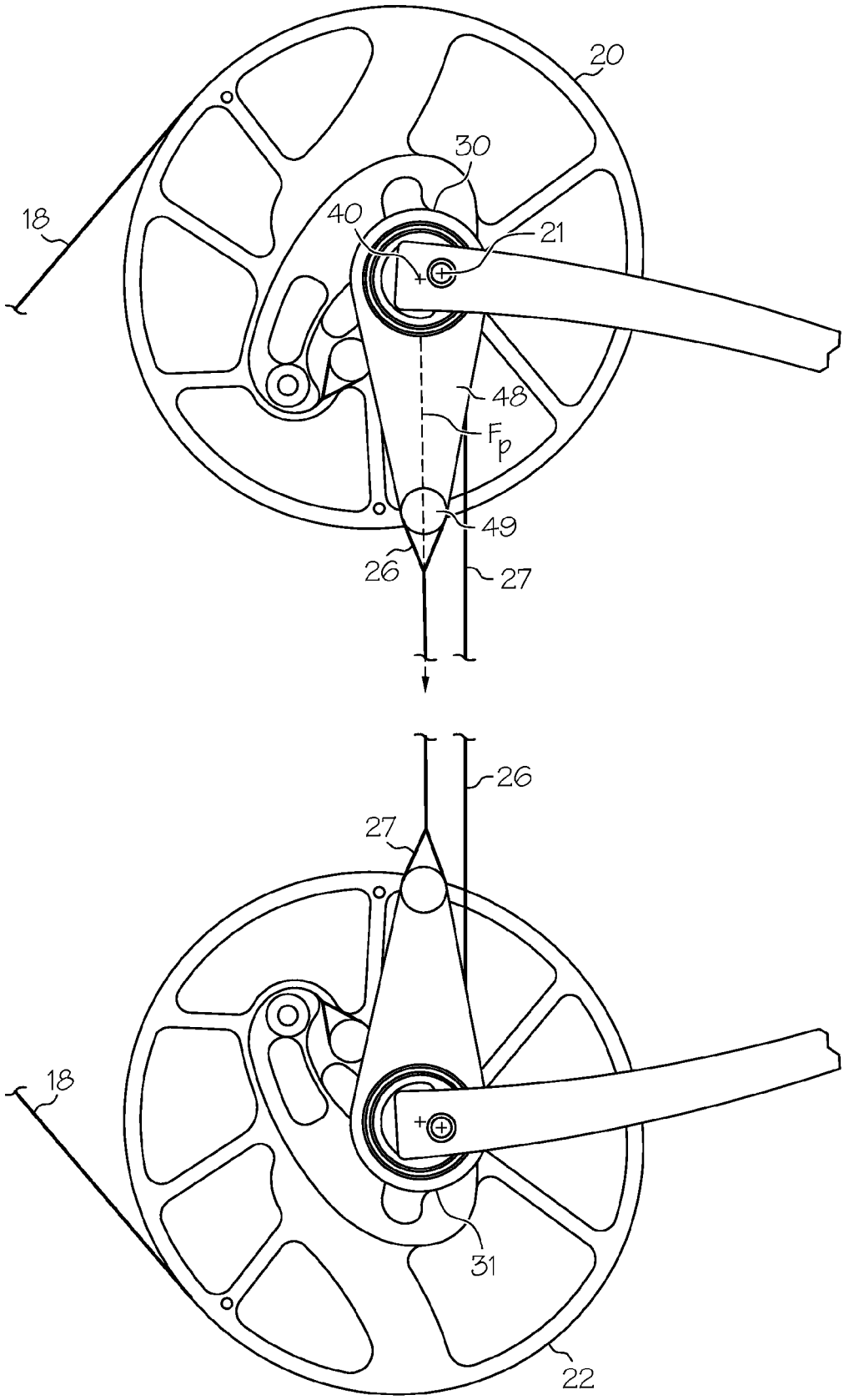

FIGS. 11 and 12 show the rotatable members 20, 22 at mid-draw and full draw orientations, respectively. Forces acting upon the rotatable members 20, 22 in these Figures are similar to the forces described with respect to FIGS. 4 and 5. As the bowstring 18 is drawn, the location of the first power cable force vector $F_p$ shifts from one side of the first rotatable member axis 21 to the other. As shown in FIG. 11, the first power cable force vector $F_p$ is moving through a substantially neutral position where it does not apply a moment to the first rotatable member 20 about the first rotatable member axis 21. In FIG. 12, the first power cable force vector $F_p$ has shifted to apply a moment about the first rotatable member axis 21 in the counter-clockwise direction, which works in conjunction with a moment applied by the bowstring 18 and against a moment applied by the second power cable 27.

Figure 13:
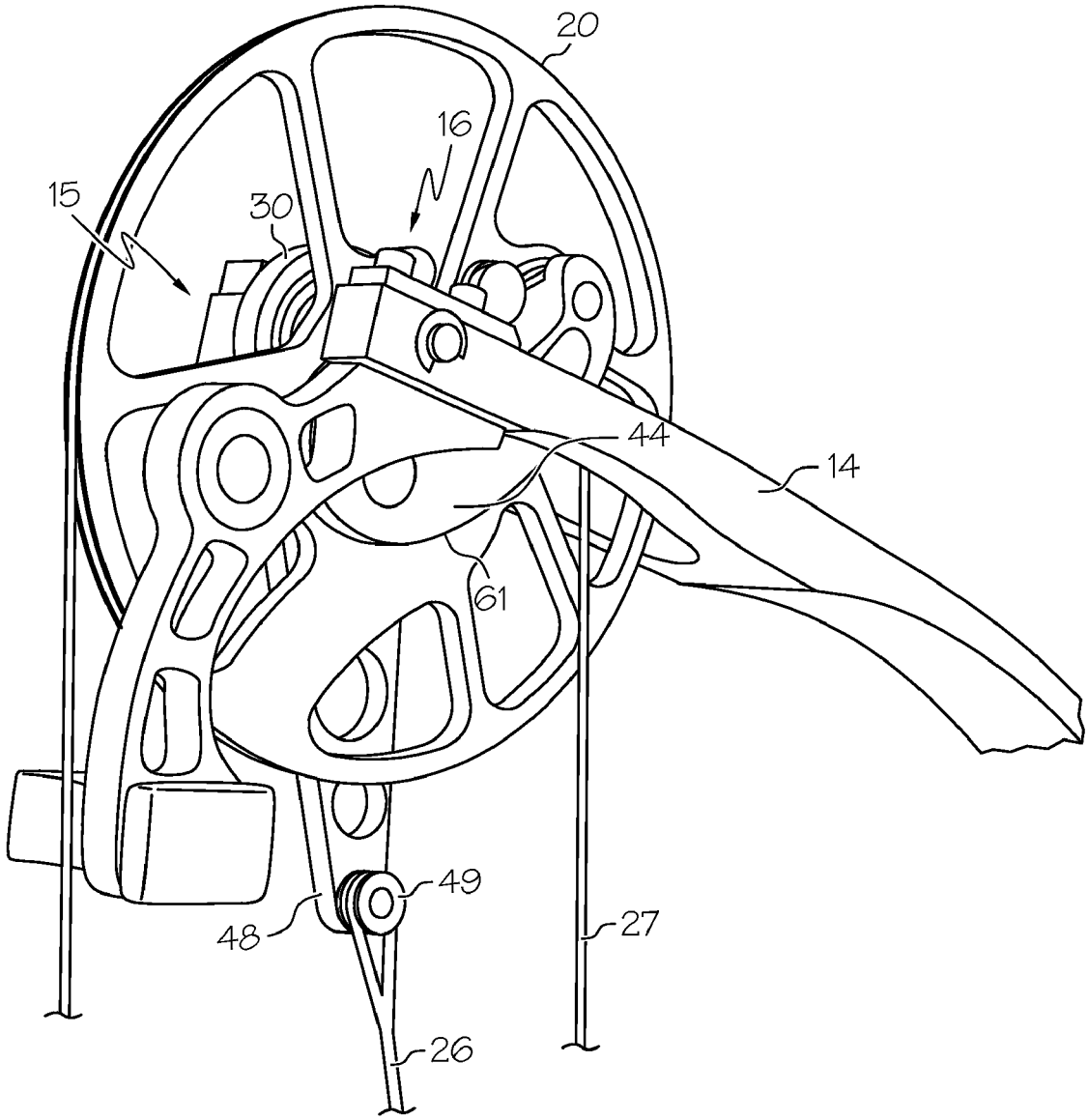
FIG. 13 shows an embodiment of a rotatable member having an embodiment of a vectoring anchor.

Although FIGS. 10-12 show first and second vectoring anchors 30, 31 and first and second power cable take-up tracks 60, 61 to one side of the rotatable members 20, 22, these elements can be distributed on different sides of the rotatable members 20, 22. For example, FIG. 13 shows a vectoring anchor 30 located to a first side 15 of a rotatable member 20. The vectoring anchor 30 comprises a plate 48, and a first power cable 26 is attached to an anchoring mechanism 49. The first power cable 26 can extend downwardly and be connected to a cam having take-up track, for example on a second rotatable member (not shown). The lower cam and take-up track could be located on either side (e.g. 15, 16) of the second rotatable member. FIG. 13 further shows a second power cable 27 anchored to a power cable cam portion 44 located to a second side 16 of the rotatable member 20, wherein the cam portion 44 comprises a take-up track 61. The second power cable 27 can extend downwardly and be anchored to a second vectoring anchor (not shown), which could be located on either side (e.g. 15, 16) of a second rotatable member.

Figure 14:
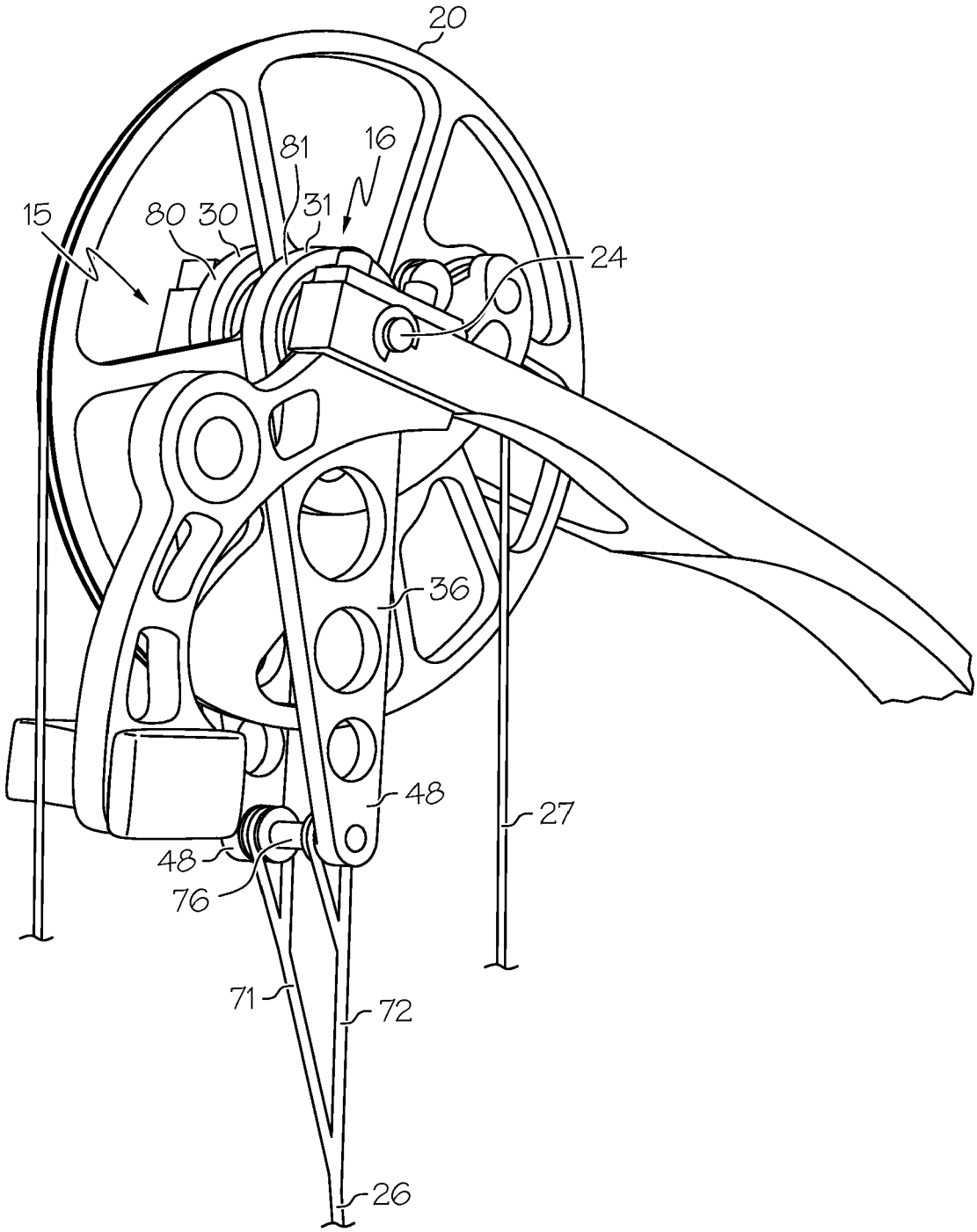
FIG. 14 shows an embodiment of a rotatable member having an embodiment of a split vectoring anchor.

FIG. 14 shows another embodiment of a vectoring anchor 30 configuration. In some embodiments, multiple vectoring anchors 30 can be used in conjunction with a single rotatable member 20. Although FIG. 14 shows vectoring anchors 30 that each comprise a plate 48, the concept of multiple vectoring anchors 30 associated with a common rotatable member 20 or axle 24 can be applied to any embodiment. A first vectoring anchor 30 and a second vectoring anchor 31 can each be rotatably attached to a rotatable member 20. For example, a first portion 34 (see e.g. FIGS. 2 and 10) of either vectoring anchor 30, 31 can be fixedly attached to the rotatable member 20, and a second portion 36 can be rotatably attached to each first portion 34. The first vectoring anchor 30 can be located to a first side 15 of the rotatable member 20, and the second vectoring anchor 31 can be located to a second side 16 of the rotatable member 20. The first power cable 26 can attach to the second portion 36 (e.g. the plate 48 as shown in FIG. 14) of each vectoring anchor 30. In some embodiments, a power cable 26 can split into a first portion 71 and a second portion 72 (e.g. split yoke). The first portion 71 can be anchored to the first vectoring anchor 30, and the second portion 72 can be anchored to the second vectoring anchor 31. In some embodiments, the second portions 36/plates 48 of the first and second vectoring anchors 30, 31 can be attached to one another, for example by a connecting member 76, such as a pin. When the second portions 36/plates 48 are attached, the power cable 26 can be anchored at a single location.

When multiple vectoring anchors 30, 31 are aligned on a common center/axis of rotation 40, the configuration can also be considered a single vectoring anchor assembly comprising a first portion 80 and a second portion 81, wherein each portion 80, 81 is rotatable with respect to the rotatable member 20.

In some embodiments, a single shaped plate can function as the two plates 48 shown in FIG. 14. Thus, in some embodiments, a vectoring anchor 30 can comprise a plate that is rotatably engaged to a rotatable member 20 at more than one location, wherein an axis of rotation (e.g. center of rotation 40—see FIG. 10) of the vectoring anchor 30 is offset from the rotatable member axis 21 (e.g. axle 24).

Figure 15:
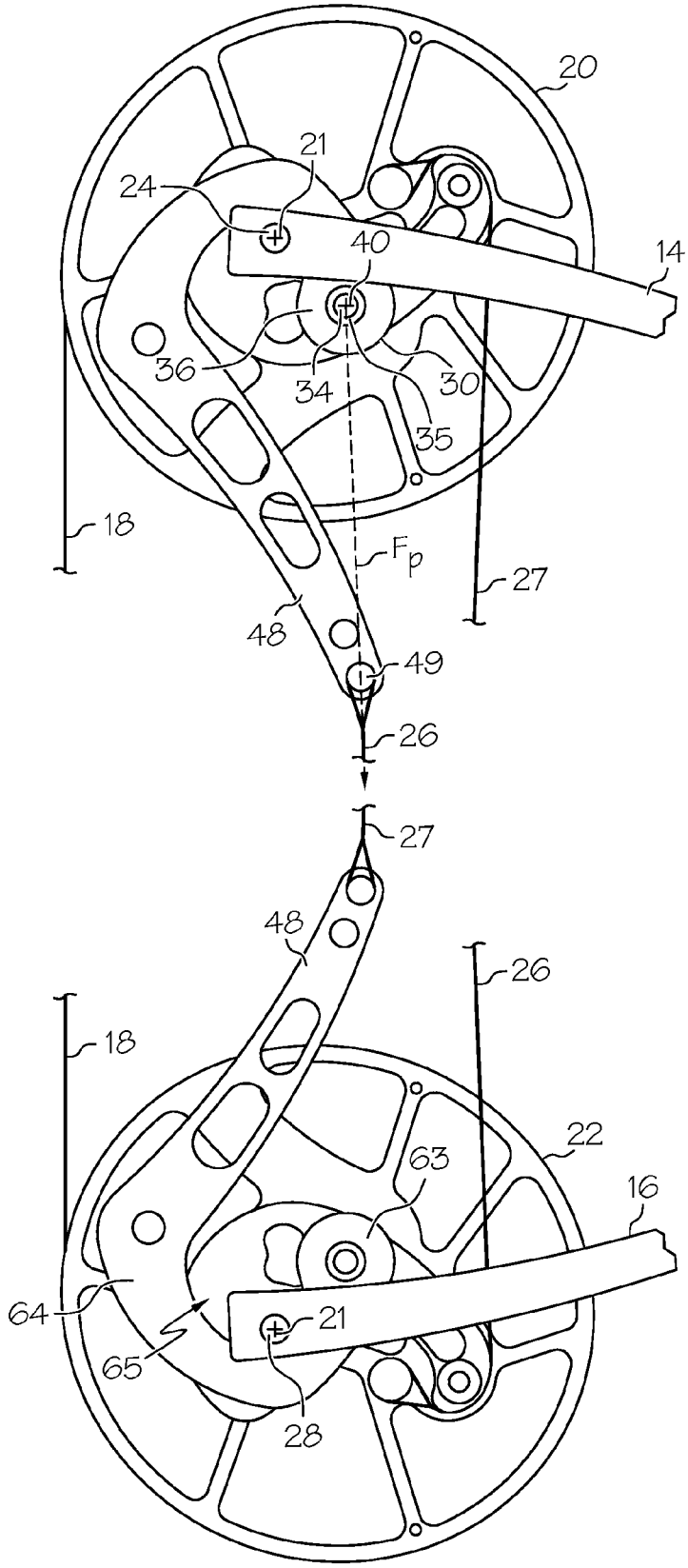
FIGS. 15-17 show another embodiment of upper and lower rotatable members at various rotational orientations, such as at-rest, mid-draw and full-draw.

FIG. 15 shows another embodiment of a vectoring anchor 30 as applied to first and second rotatable members 20, 22. Each vectoring anchor 30 is rotatably attached to a rotatable member 20, 22. A vectoring anchor 30 can comprise a first portion 34 that is fixedly attached to a rotatable member 20, 22 and a second portion 36 that is rotatably attached to the first portion 34. An axis of rotation 40 between the first and second portions 34, 36 of the vectoring anchor 30 is offset from the rotatable member axis 21 (e.g. the axle 24). In some embodiments, the axis of rotation 40 is parallel to the rotatable member axis 21.

In some embodiments, the vectoring anchor 30 defines a rotational engagement circumference 35 between the first portion 34 and the second portion 36, and the rotatable member axis 21 is located outside of the rotational engagement circumference 35.

In some embodiments, a vectoring anchor 30 comprises an extension member 48 such as a plate, which can be asymmetric across at least one axis. In some embodiments, a plate 48 is asymmetric across the power cable force vector $F_p$. In some embodiments, a plate 48 comprises a first portion 63 that is oriented about the axis of rotation 40 and a second portion 64, such as an arm portion, that extends away from the first portion 63 and anchors to the associated power cable (e.g. 27). In some embodiments, an arm portion 64 extends from the first portion 63 of the plate in a direction away from the associated power cable (e.g. 27), around the rotatable member axis 21 (e.g. axle 28) in a direction toward the bowstring 18, then toward the associated power cable (e.g. 27) and away from the bowstring 18. This configuration creates a groove 65 in the plate, defined between the first portion 63 and the arm portion 64, through which the rotatable member axis 21 (e.g. axle 28) passes as the bowstring 18 is drawn and the rotatable members 20, 22 rotate.

In some other embodiments, a plate 48 can be symmetric across the power cable force vector $F_p$, for example as discussed previously with respect to FIG. 10. A more symmetrical plate can reduce bending stresses that can exist in an asymmetrical plate. It should be noted that FIG. 10 shows an embodiment of a symmetrical plate 48 wherein the rotatable member axis 21 is oriented within an area defined by the first portion 34 of the vectoring anchor 30 (e.g. within a circumference of the first portion 34), whereas FIG. 15 shows an embodiment of an asymmetrical plate 48 wherein the rotatable member axis 21 is oriented outside of an area defined by the first portion 34 of the vectoring anchor 30. Symmetrical or asymmetrical plates 48 can be used with either type of rotatable member axis 21 orientation. For example, the asymmetrical plate of FIG. 15 could be combined with a mirror image of itself taken across the power cable force vector $F_p$, resulting in a heart-shaped plate. Different plate 48 embodiments allow for differences in strength, weight and aesthetics. Further, a plate 48 associated with a first rotatable member 20 can be different from a plate 48 associated with a second rotatable member 22.

Figure 16:
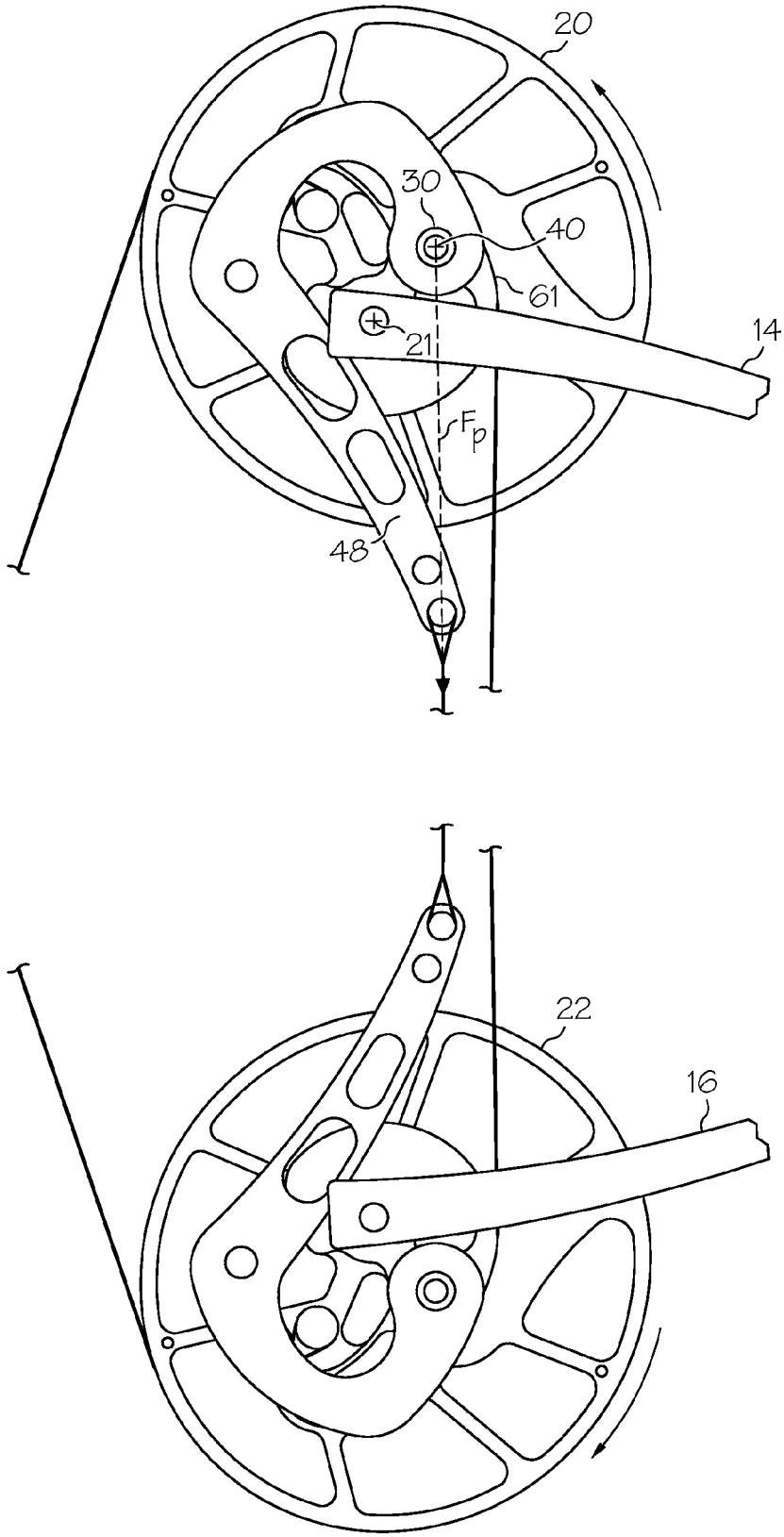

FIG. 16 shows the rotatable members 20, 22 of FIG. 15 in a mid-draw orientation. As a rotatable member 20, 22 rotates, the center of rotation 40 of each vectoring anchor 30 translocates about the associated rotatable member axis 21. As the rotatable member 20 rotates from a brace orientation as shown in FIG. 15 to a mid-draw orientation, the power cable force vector $F_p$ can move closer to the rotatable member axis 21. Thus, a moment arm between the rotatable member axis 21 and the power cable force vector $F_p$ can be reduced in length. As the rotatable member 20 continues to rotate, the power cable force vector $F_p$ can pass over/through the rotatable member axis 21.

Figure 17:
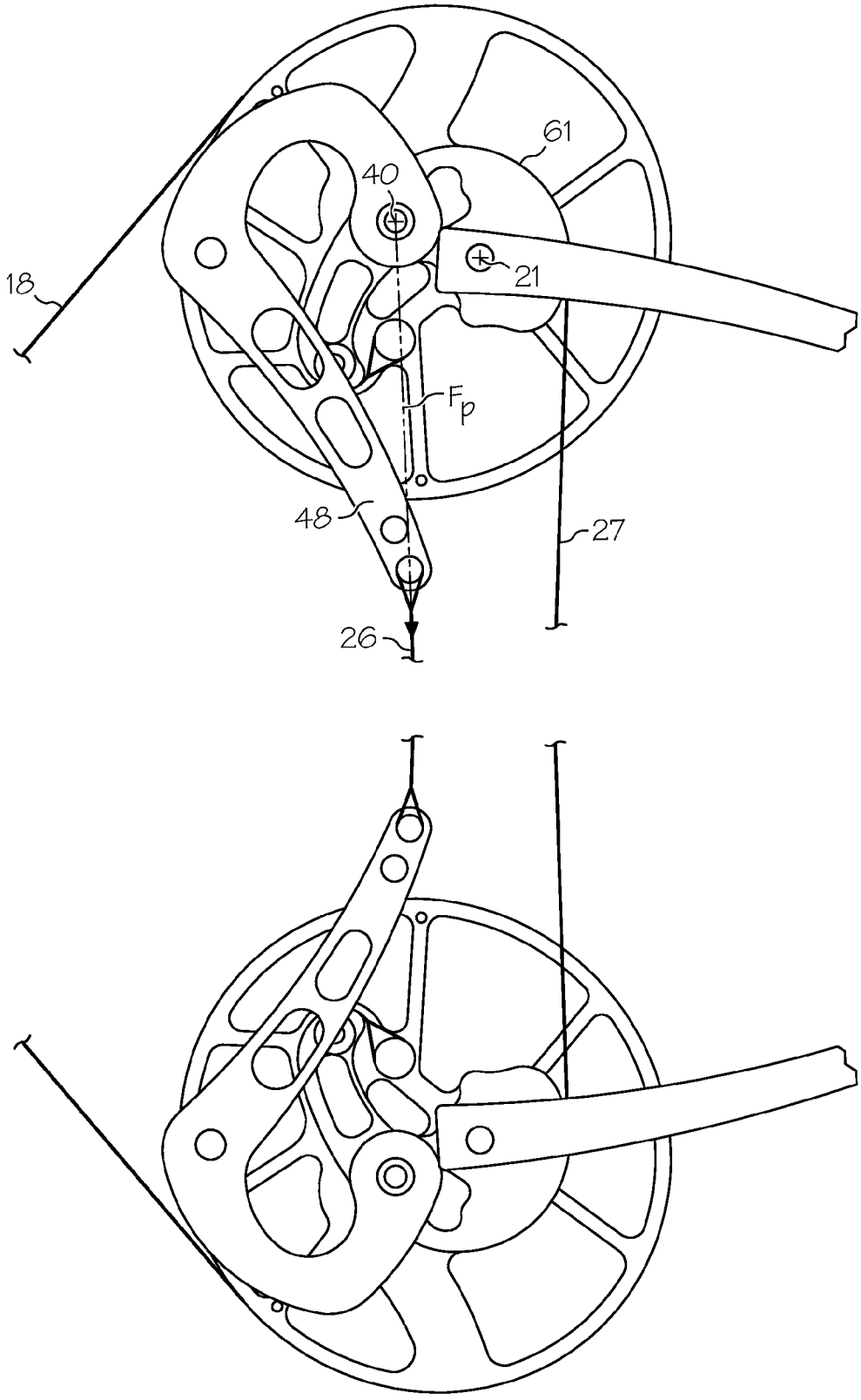

FIG. 17 shows the rotatable members 20, 22 of FIGS. 15 and 16 at a full draw orientation. The power cable force vector $F_p$ has moved to the bowstring 18 side of the rotatable member axis 21. Thus, the bowstring 18 and first power cable 26 apply moments to the rotatable member 20 in a common direction, for example counterclockwise. The moments from the bowstring 18 and first power cable 26 act against a moment applied by the second power cable 27 in the opposite direction, for example clockwise.

Although FIGS. 15-17 show a plate 48 and a second power cable take-up track 61 oriented to a common side of a rotatable member, other embodiments are possible, for example as described herein with respect to FIGS. 3-5 and 10-14. For example, a plate 48 and second power cable take-up track 61 can be located on opposite sides of a rotatable member.

FIG. 18 shows a three-dimensional view of another embodiment of a rotatable member 20 having an embodiment of a vectoring anchor 30. The rotatable member 20 comprises a bowstring groove 46 that extends around its outer periphery. The rotatable member 20 is arranged to rotate about rotatable member axis 21, for example being supported by an axle 24. The rotatable member 20 can comprise a take-up track (not visible in FIG. 18), which can take-up a cable, such as a second power cable 27 as the bowstring 18 is drawn.

In some embodiments, a vectoring anchor 30 or a portion of a vectoring anchor 30 can be located laterally outward from a bow limb 14. Thus, a power cable 26 can anchor to the vectoring anchor 30 laterally outward from the bow limb 14, such that a portion of the limb 14 can be oriented between the rotatable member 20 and the power cable 26 in at least some rotatable member 20 orientations.

In some embodiments, a vectoring anchor 30 can comprise two portions 80, 81 that are oriented on opposite sides of the rotatable member 20. Each portion 80, 81 can be rotatable with respect to the rotatable member 20, and both portions 80, 81 can be aligned on a common axis of rotation 40. A power cable 26 can split into a first portion 71 and a second portion 72, and each portion 71, 72 can be anchored to a respective vectoring anchor portion 80, 81. In some embodiments, the cable first portion 71 and vectoring anchor first portion 80 can comprise a mirror image of the cable second portion 72 and vectoring anchor second portion 81, which helps balance the forces applied to the rotatable member 20 by the power cable 26. A multiple portion 80, 81 vectoring anchor assembly 30 can also be described as two separate vectoring anchors 30, 31.

In some embodiments, a rotatable member 20 can comprise a post 78 that extends outward in a lateral direction. For example, a central axis of the post 78 can be oriented parallel to the rotatable member axis 21. A vectoring anchor 30 can be located at an end of the post 78. In some embodiments, a post 78 can extend laterally on each side of a rotatable member 20 as shown in FIG. 18, and the two posts 78 can be coaxially aligned. In some embodiments, a central axis of a post 78 is collinear with the center of rotation 40 of a vectoring anchor 30. In some embodiments, a post 78 can also be characterized as a portion of a vectoring anchor 30.

Figure 19:
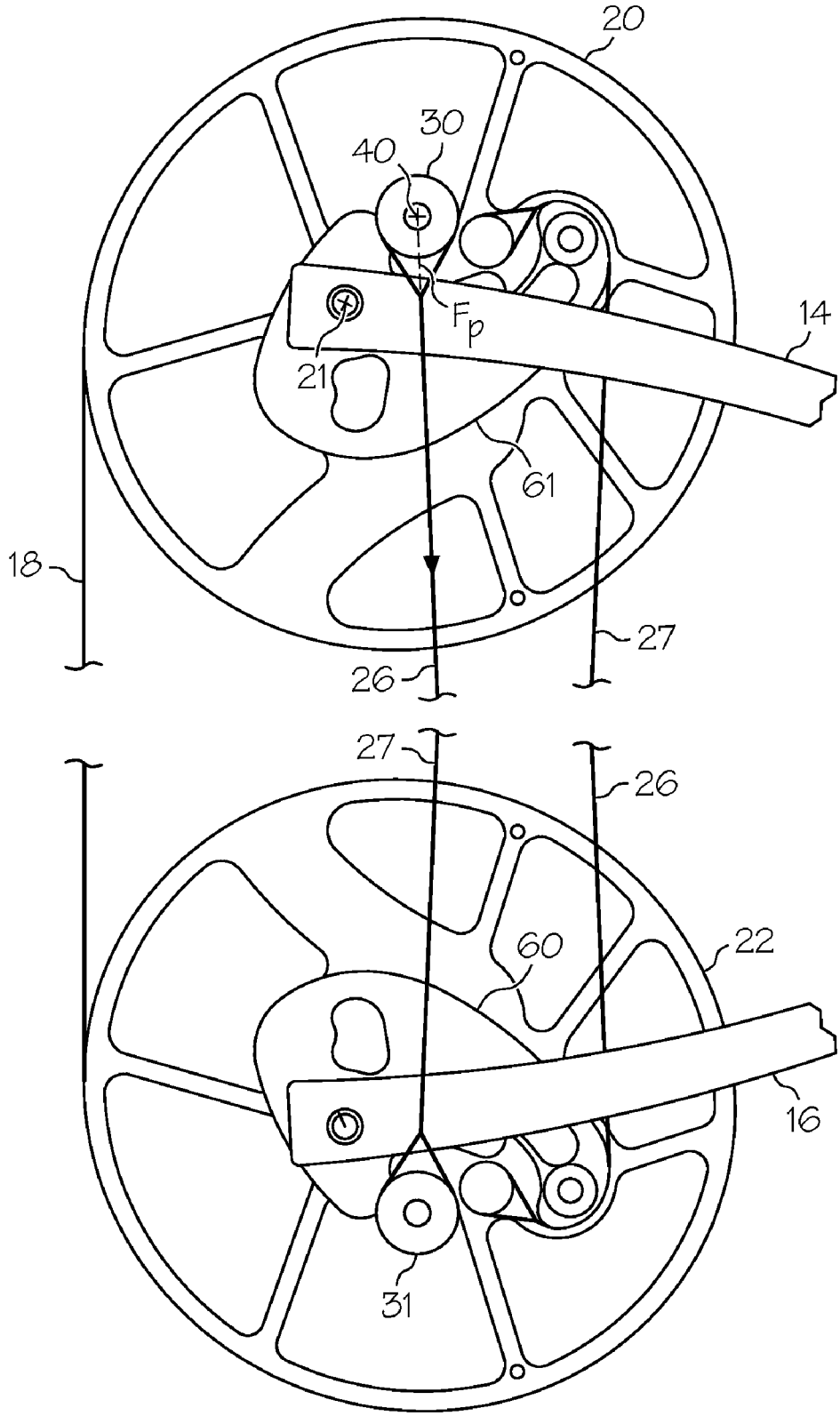
FIGS. 19-21 show another embodiment, similar to FIG. 18, of upper and lower rotatable members at various rotational orientations, such as at-rest, mid-draw and full-draw.
Figure 20:
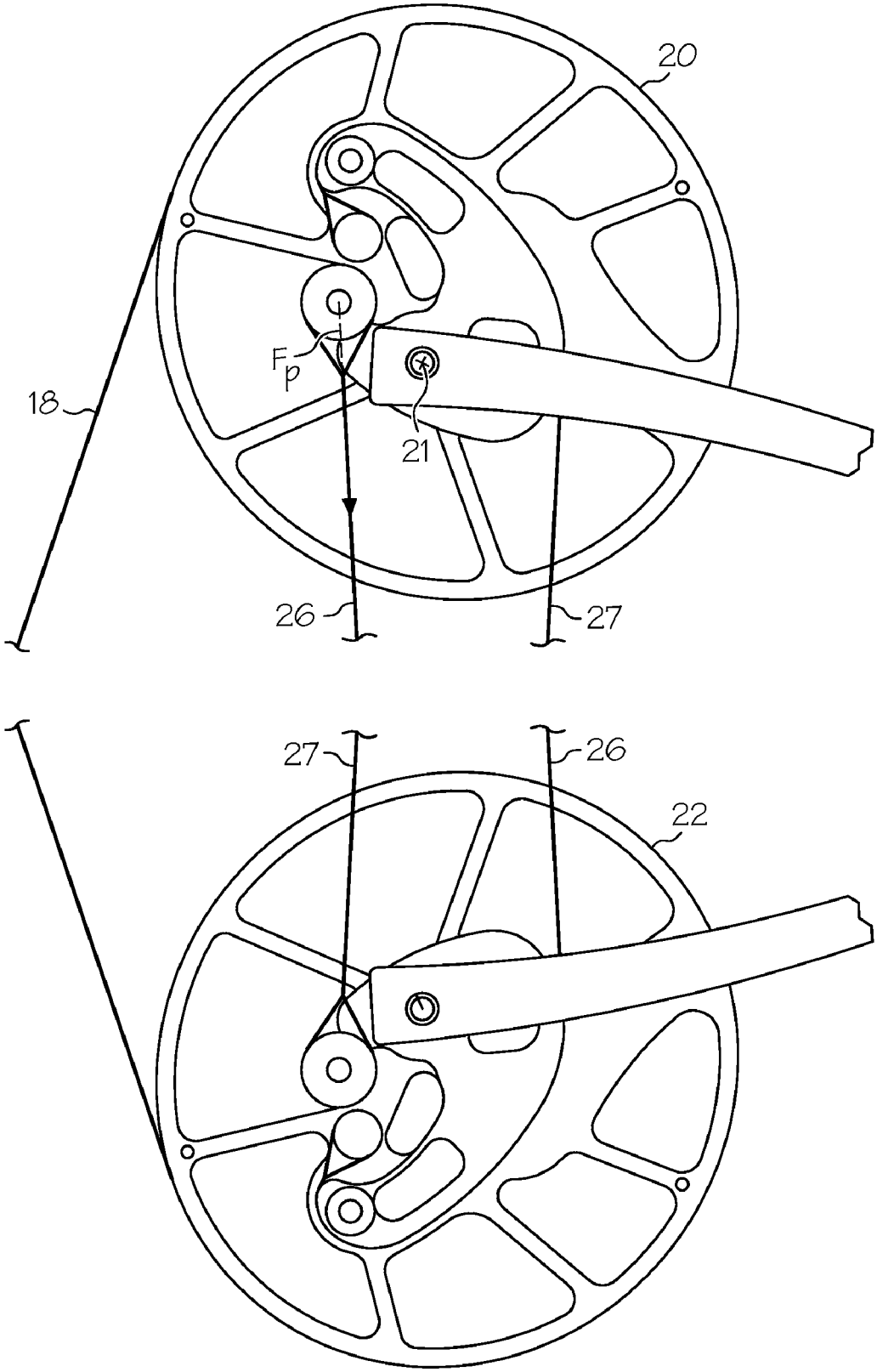
Figure 21:
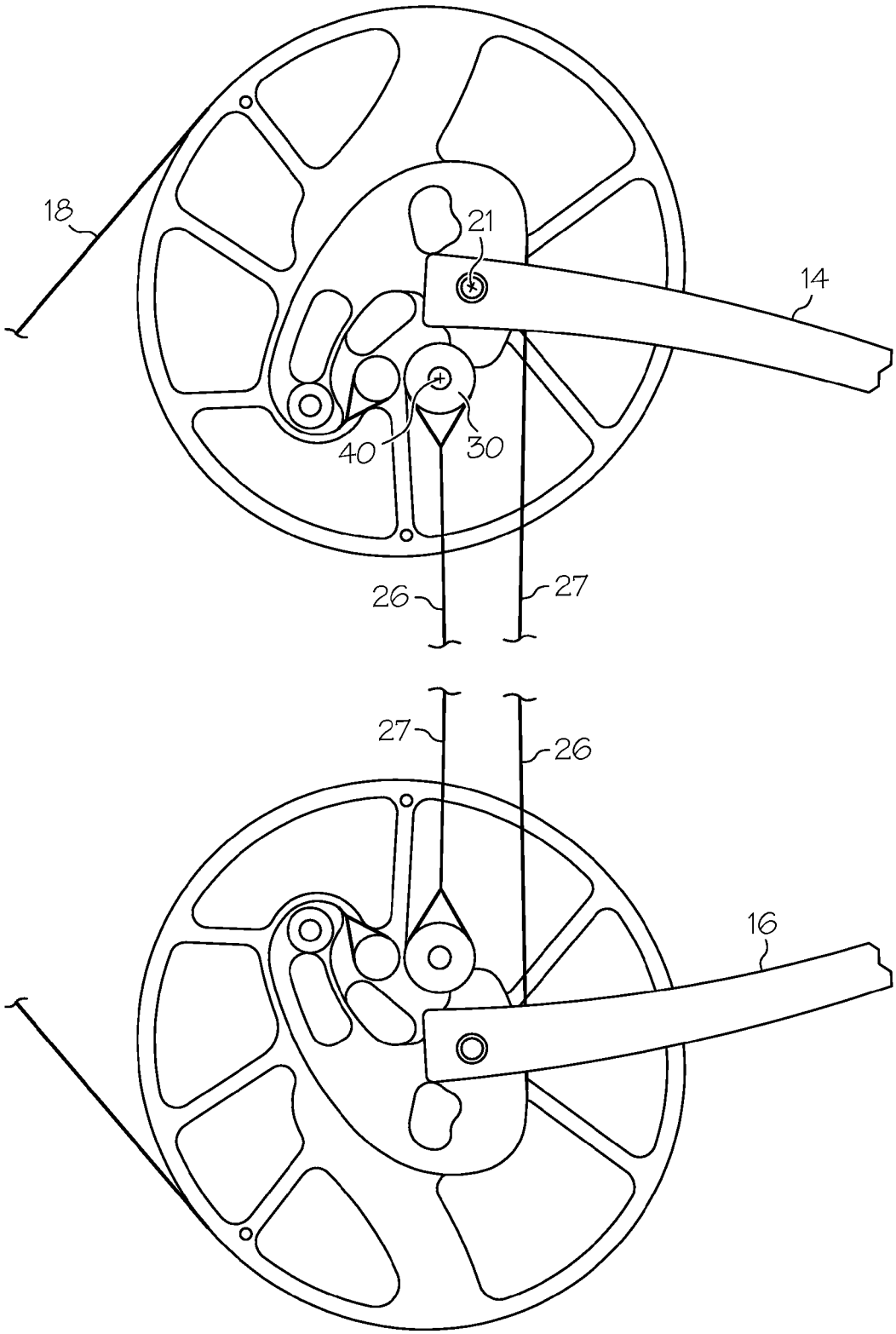

FIGS. 19-21 show another embodiment of rotatable members 20, 22 various rotational orientations. Each rotatable member 20, 22 comprises a vectoring anchor 30, such as a vectoring anchor 30 comprising first and second portions 80, 81 as described with respect to FIG. 18. The vectoring anchor 30 can comprise portions 80, 81 that are located laterally outward from the limb 14, such that a portion of the limb 14 can be located between a portion of the power cable 26 and the rotatable member 20.

FIG. 19 shows the rotatable members 20, 22 in the brace condition. Forces acting upon the rotatable members 20, 22 are similar to the forces described with respect to FIG. 3. The first power cable force vector $F_p$ applies a moment to the first rotatable member 20 about the first rotatable member axis 21 that acts in conjunction with a moment applied by the second power cable 27, and against a moment applied by the bowstring 18.

FIGS. 20 and 21 show the rotatable members 20, 22 at mid-draw and full draw orientations, respectively. Forces acting upon the rotatable members 20, 22 in these Figures are similar to the forces described with respect to FIGS. 4 and 5. As the bowstring 18 is drawn, the location of the first power cable force vector $F_p$ shifts from one side of the first rotatable member axis 21 to the other. As shown in FIG. 20, the first power cable force vector $F_p$ has already moved past a substantially neutral moment position and is applying a moment to the rotatable member 20 in the counter-clockwise direction. This moment works in conjunction with a counter-clockwise moment applied by the bowstring 18, and against a clockwise moment applied by the second power cable 27.

In another embodiment (not illustrated), referring to FIGS. 18-21, it is not necessary for the vectoring anchor 30 to be rotatable with respect to the rotatable member 20. For example, in some embodiments, the vectoring anchor 30 can be fixedly attached to the rotatable member 20, and the power cable 26 can be rotatable with respect to the vectoring anchor 30 about a center of rotation 40, for example being configured to slide or slip with respect to the vectoring anchor 30 as the bow is drawn, as previously discussed herein.

Figure 22:
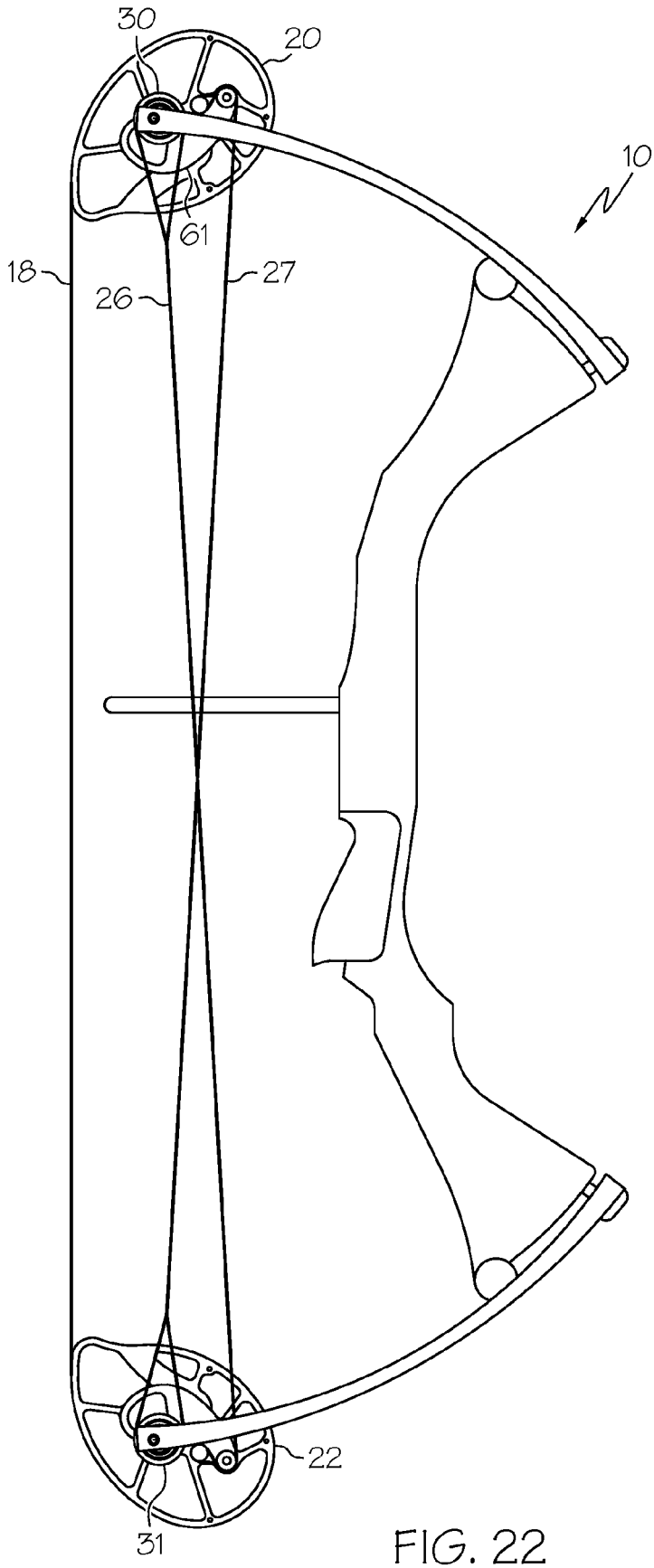
FIG. 22 shows another embodiment of an archery bow.

FIG. 22 shows another embodiment of a bow 10 comprising vectoring anchors 30, 31. The bow 10 is similar in many ways to the embodiment illustrated in FIG. 1; however, FIG. 22 shows an alternate embodiment of rotatable members 20, 22. FIG. 22 shows an alternate shape for a power cable take-up track 61, and an alternate shape for an outer periphery of the rotatable member 20 when compared to FIG. 1. The outer periphery can comprise a track for the bowstring 18. Thus, the configuration of a rotatable member 20 can be adjusted to achieve desirable characteristics in draw force and let-off profile by adjusting the cam shapes to adjust the specific moments applied to the rotatable member 20 by the various cables 18, 26, 27.

FIG. 22 shows that the vectoring anchor 30 concept can be applied to many configurations of bows 10, and that different embodiments of rotatable members 20 can be used without departing from the invention. The vectoring anchor 30 concept is applicable to any suitable type of compound archery bow, including single cam bows, CPS bows, cam-and-a-half bows, dual and twin cam bows, crossbows, etc. Some of these types of bows are discussed in greater detail below.

Figure 23:
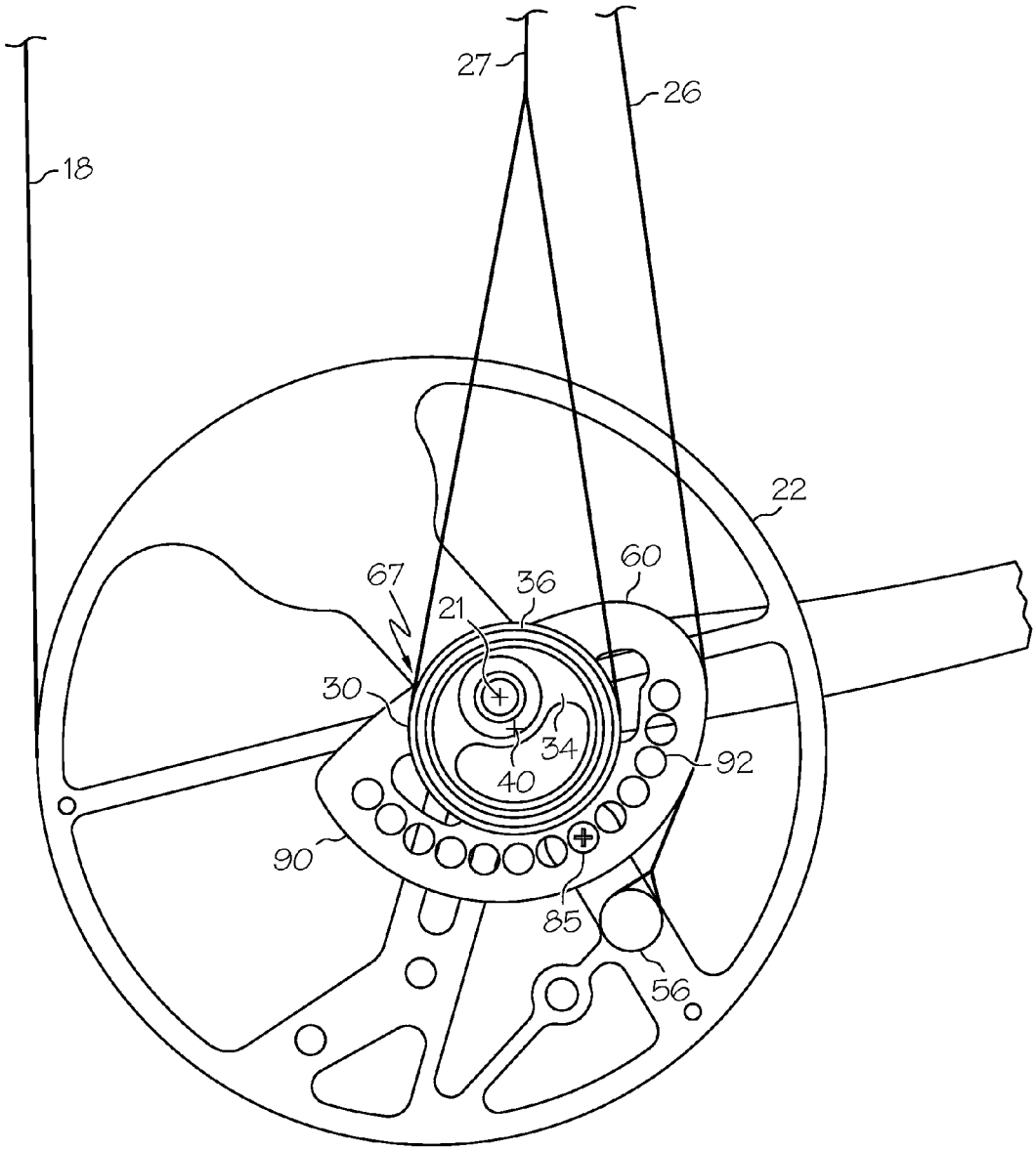
FIGS. 23-25 show an embodiment of a rotatable member having an adjustable module at various orientations.

FIG. 23 shows another embodiment of a rotatable member 22 that utilizes a vectoring anchor 30. In some embodiments, a module 90 can be attached to the rotatable member 22, and the module 90 can comprise a vectoring anchor 30. As such, the vectoring anchor 30 can comprise a first portion 34 that is rotatable with respect to a second portion 36 about a center of rotation 40. The first portion 34 can be fixedly attached to the module 90. A cable, such as a second power cable 27, can be anchored to the second portion 36.

The module 90 further comprises a cable take-up track 60. As the rotatable member 22 is rotated as the bowstring 18 is drawn, a cable such as a power cable 26 can be taken up by the cable take-up track 60. The cable take-up track 60 can comprise a power let-off portion 67, wherein the amount of force required to keep the bowstring 18 drawn is reduced as the power cable 26 is taken up in the cable take-up track 60 and approaches the power let-off portion 67. A person of ordinary skill in the art will recognize that certain properties of the bow, such as the draw force profile, can be adjusted by varying the specific shape and orientation of the cable take-up track 60, for example in relation to the bowstring 18 payout track.

In some embodiments, a module 60 can be repositioned with respect to the rotatable member 22. For example, in some embodiments, a module 60 can be rotated about the rotatable member axis 21. As such, the module 60 can be configured for attachment to the rotatable member 22 in multiple orientations. In some embodiments, a fastener 85 such as a machine screw can be used to fasten the module 60 to the rotatable member 22. The rotatable member 22 can comprise a fastener receiving portion, such as a threaded aperture. In some embodiments, a module 60 comprises a plurality of apertures 92, wherein each aperture 92 allows the module 60 to be attached to the rotatable member 22 at a different rotational orientation. When a module 60 comprises a vectoring anchor 30, the location of the center of rotation 40 can be adjusted along with the orientation of the cable take-up track 60.

The rotatable member 22 can comprise a power cable terminal 56, such as a post, to which the power cable 26 can be anchored. The power cable 26 can be anchored to a groove in the post (not visible in FIG. 23), and the cable take-up track 60 and the groove can be oriented on a common plane.

Figure 24:
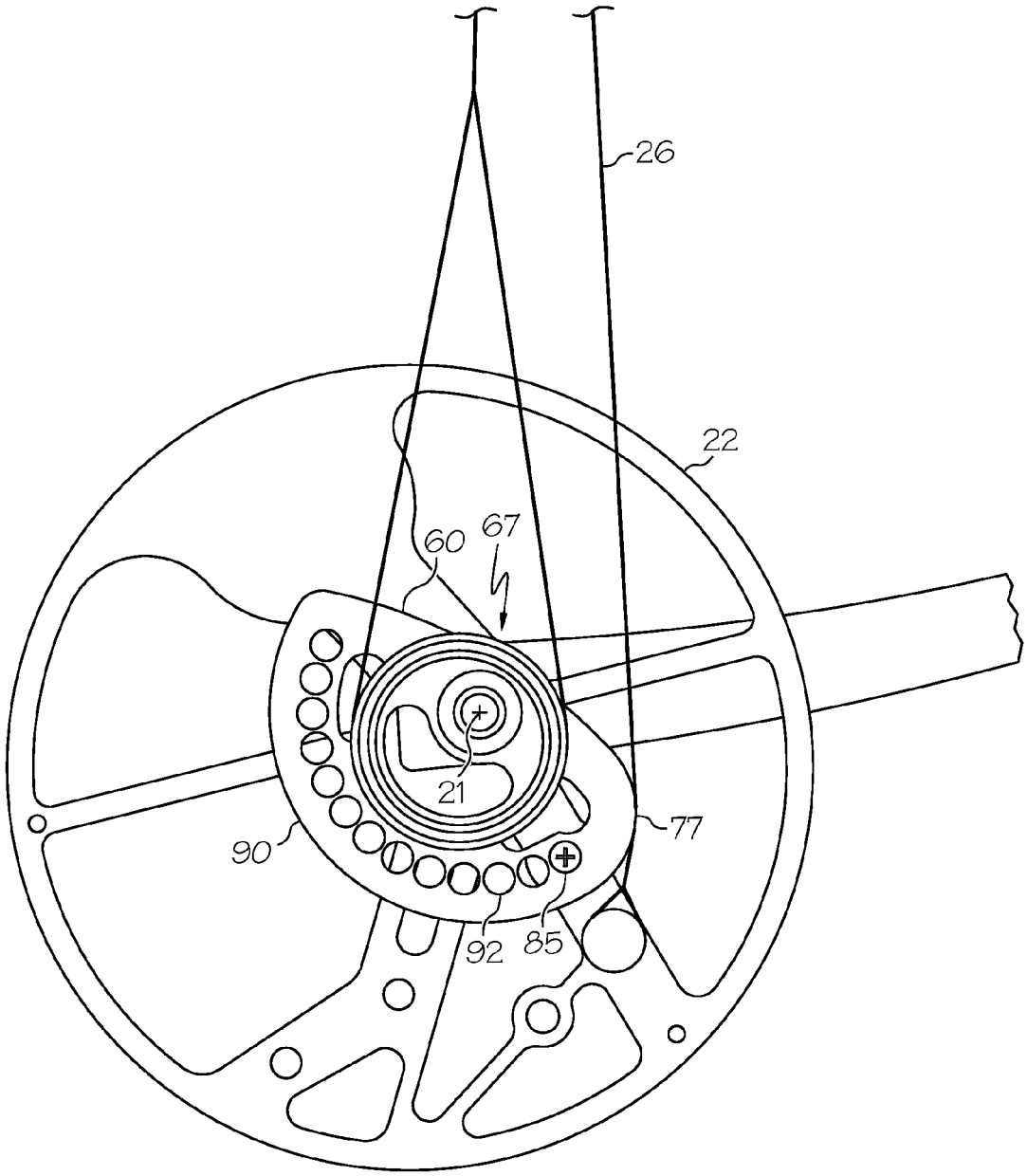

FIG. 24 shows the rotatable member 22 and module 90 of FIG. 23 in an alternate configuration. The fastener 85 is oriented in the first of thirteen fastener apertures 92. In this orientation, the let-off portion 67 of the cable take-up track 60 is oriented closest to the power cable 26 of any module 90 orientation, such that the distance along the cable take-up track 60 between a brace condition power cable contact point 77 and the let-off portion 67 is the least of any module 90 orientation. This orientation results in the minimum bow draw length of an adjustable draw length range provided by the adjustable module 90.

Figure 25:
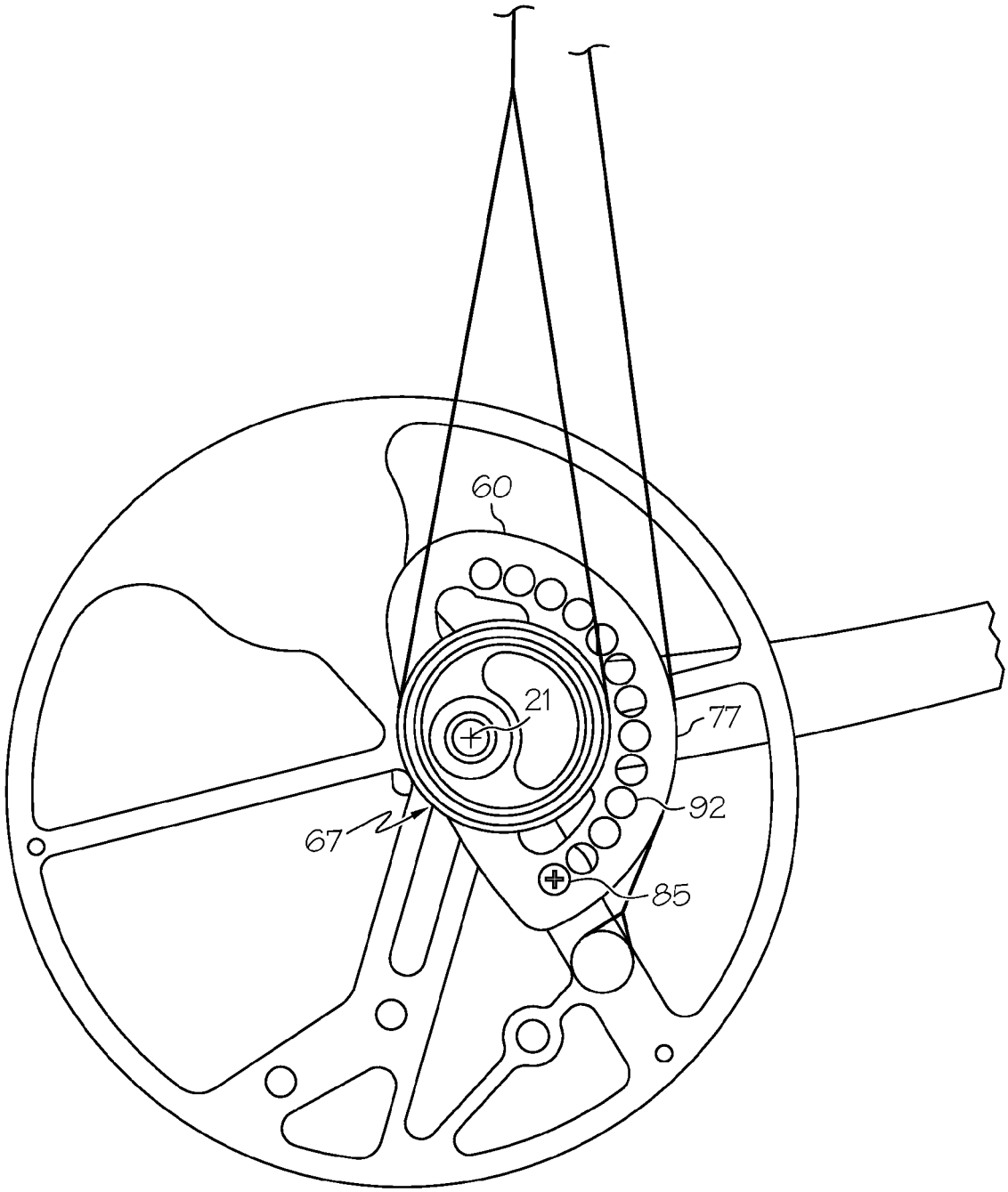

FIG. 25 shows the rotatable member 22 and module 90 of FIG. 23 in an alternate configuration. The fastener 85 is oriented in the last of thirteen fastener apertures 92. In this orientation, the let-off portion 67 of the cable take-up track 60 is oriented farthest from the power cable 26 of any module 90 orientation, such that the distance along the cable take-up track 60 between a brace condition power cable contact point 77 and the let-off portion 67 is the greatest of any module 90 orientation. This orientation results in the maximum bow draw length of an adjustable draw length range provided by the adjustable module 90.

Figure 26:
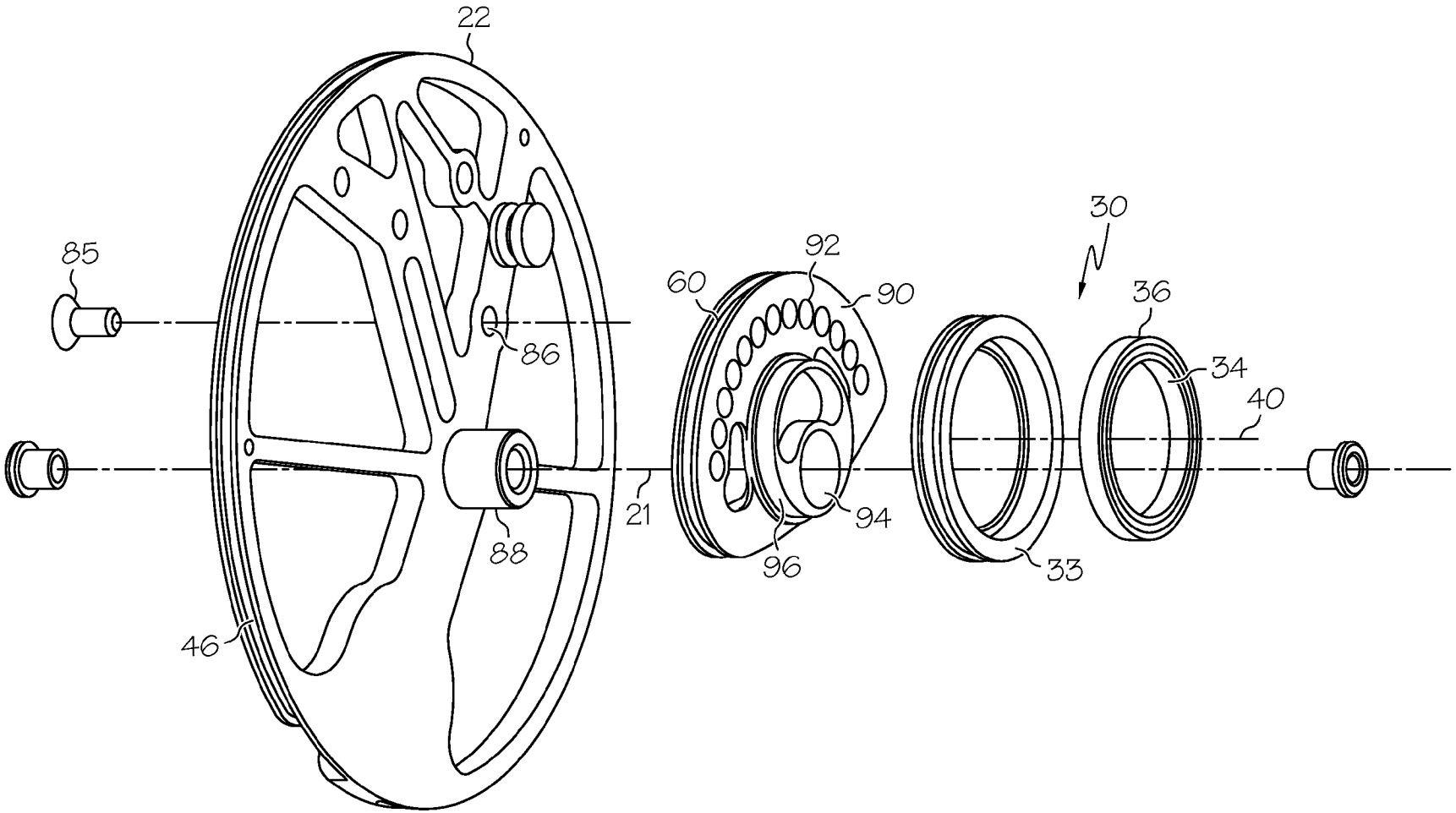
FIG. 26 shows an exploded view of an embodiment of a rotatable member and a module comprising a vectoring anchor.

FIG. 26 shows an exploded view of a rotatable member 22, module 90 and vectoring anchor 30 similar to that of FIG. 23. The rotatable member 22 comprises a hub 88 that can be received in a hub aperture 94 of the module 90. In some embodiments, a central axis of the hub 88 comprises the rotatable member axis 21. The module 90 is rotatable about the hub 88, and can be fixedly attached to the rotatable member 22 with the fastener 85. In some embodiments, the fastener 85 can extend through an aperture 86 and engage a portion of the module 90, such as a threaded aperture 92.

The vectoring anchor 30 can comprise a first portion 34 rotatable with respect to a second portion 36. In some embodiments, the first portion 34 and second portion 36 comprise a bearing, such as a rolling element bearing. The first portion 34 can be attached to module 90. In some embodiments, the first portion 34 can engage a raised hub 96 on the module 90. In some embodiments, the vectoring anchor 30 can comprise a sheave 33 that defines a track or groove about its outer periphery. The sheave 33 can be attached to said second portion 36.

Figure 27:
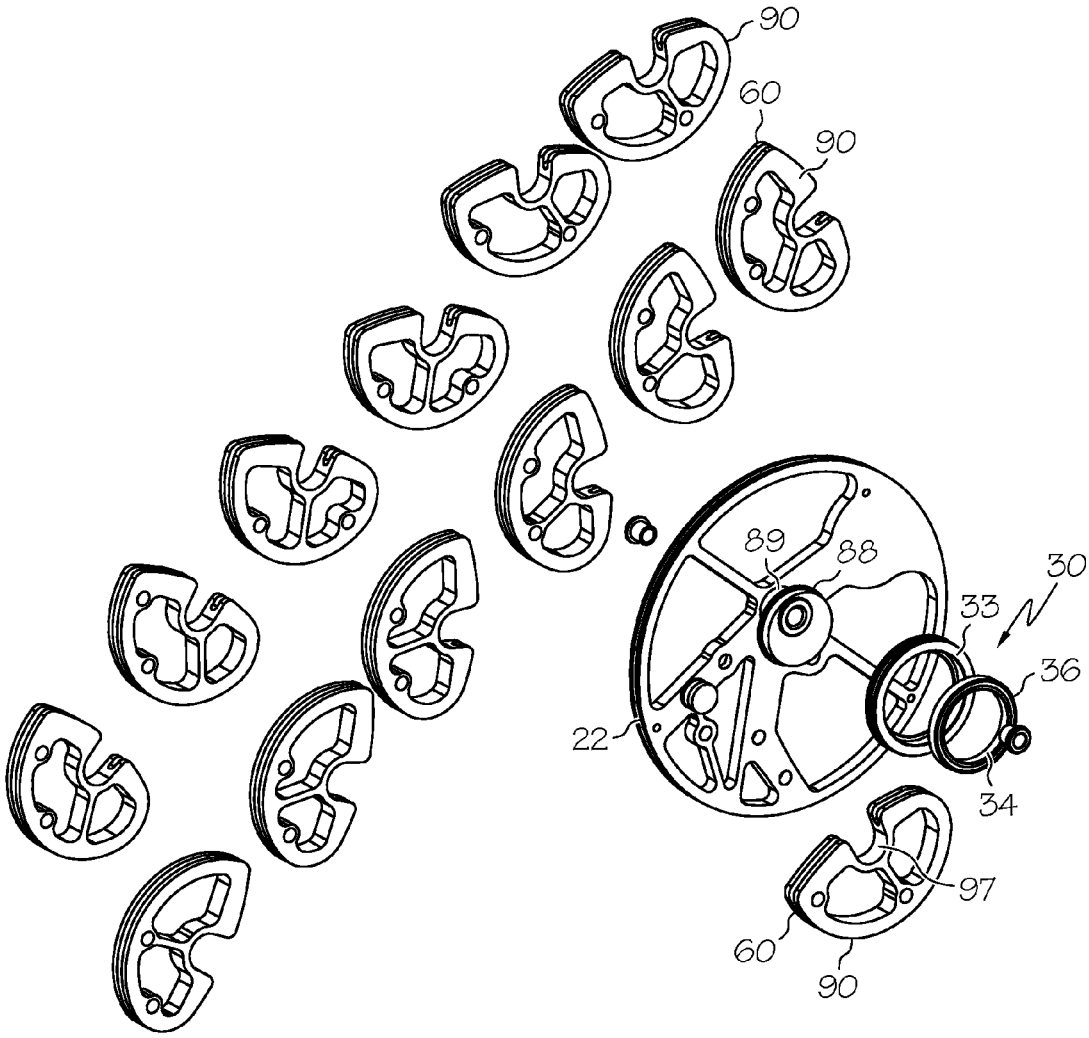
FIG. 27 shows an exploded view of another embodiment of a rotatable member comprising a vectoring anchor and having interchangeable modules.

Although FIGS. 23-26 illustrate a single module 90 that is capable of multiple orientations, a rotatable member 22 can also be used in conjunction with a plurality of replaceable modules, for example as described with respect to FIG. 27.

FIG. 27 shows another embodiment of a rotatable member 22 comprising a vectoring anchor 30. This embodiment allows for the use of adjustable or replaceable modules 90; however, adjustment of the module(s) 90 does not adjust the orientation of the vectoring anchor 30. The rotatable member 22 can comprise a stalk 89 and a raised hub 88. The raised hub 88 can engage the vectoring anchor 30. A module 90 can be attached to the rotatable member 22. For example, a module 90 can be oriented between the main body and the raised hub 88 of the rotatable member 22, such that an abutting portion 97 of the module 90 abuts the stalk 89.

A module 90 can comprise a plurality of apertures 92, for example as shown in FIG. 23, which allow for a plurality of fixed orientations with respect to the rotatable member 22. Further, a plurality of separate modules 90 can be used, wherein the modules 90 are interchangeable. Thus, each module 90 provides for a different cable take-up track 60 orientation. FIG. 27 shows thirteen interchangeable modules 90, wherein each module 90 provides bow characteristics similar to a particular aperture 92/orientation setting of the adjustable module 90 shown in FIG. 23. In some embodiments, different modules 90 comprise the same cable take-up track 60 shape. In some embodiments, different modules 90 comprise different cable take-up track 60 shapes, such that various characteristics of the bow can be adjusted to a greater degree.

The module 90 embodiments shown in FIGS. 23-27 all allow for adjustment/replacement of the module 90 without requiring removal of the power cable(s) 26, 27.

A person of ordinary skill in the art will recognize that adjustable and interchangeable modules 90 allow for many characteristics of a bow to be adjusted, such as draw length, draw force, peak draw weight, draw force let-off and more generally the overall draw force profile curve. Benefits of such modules 90 are discussed in U.S. Pat. Nos. 4,461,267, 4,515,142, 4,519,374, 4,774,927, 4,967,721, 5,678,529, 5,782,229, 5,934,265, 5,960,778, 6,082,347, 6,516,790, 6,990,970 and 6,994,079, the entire disclosures of which are hereby incorporated herein in their entireties.

Figure 28:
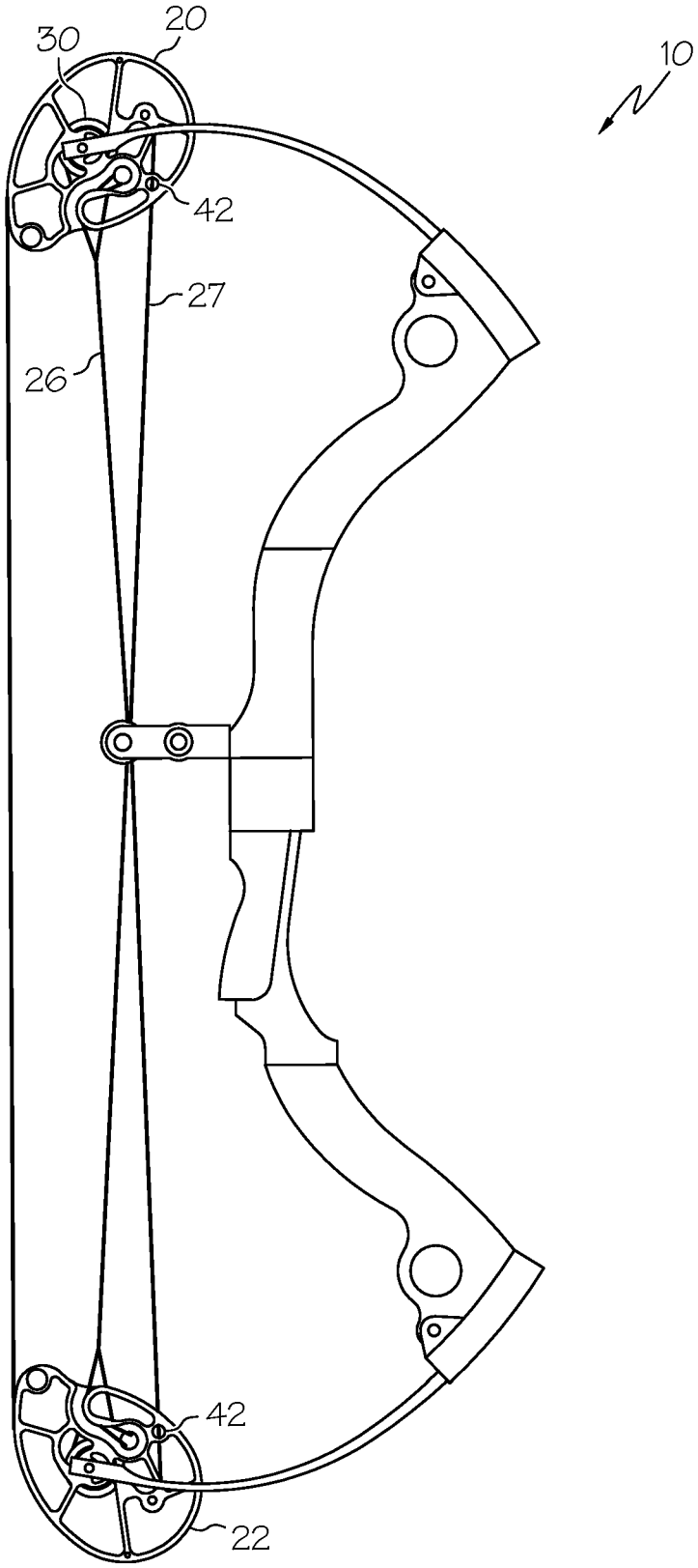
FIG. 28 shows another embodiment of an archery bow comprising cams that each have a timing window.

FIG. 28 shows another embodiment of a bow 10 comprising a vectoring anchor 30. In some embodiments, a rotatable member 20, 22 can comprise a timing window 42. A timing window 42 can comprise an aperture in the rotatable member 20, 22 through which a power cable 26, 27 can be visible. The timing window 42 can be used to verify that the upper rotatable member 20 and the lower rotatable member 22 are in proper rotational alignment. For example, when properly aligned, a power cable 26 can be centered in the timing window 42. Desirably a distance across the timing window 42 is larger than a diameter of the cable 26 but also small enough that it is not difficult to perceive when the cable 26 is centered in the timing window 42. For example, in some embodiments, a distance across the timing window 42 can range from one to four times the diameter of the cable 26.

Figure 29:
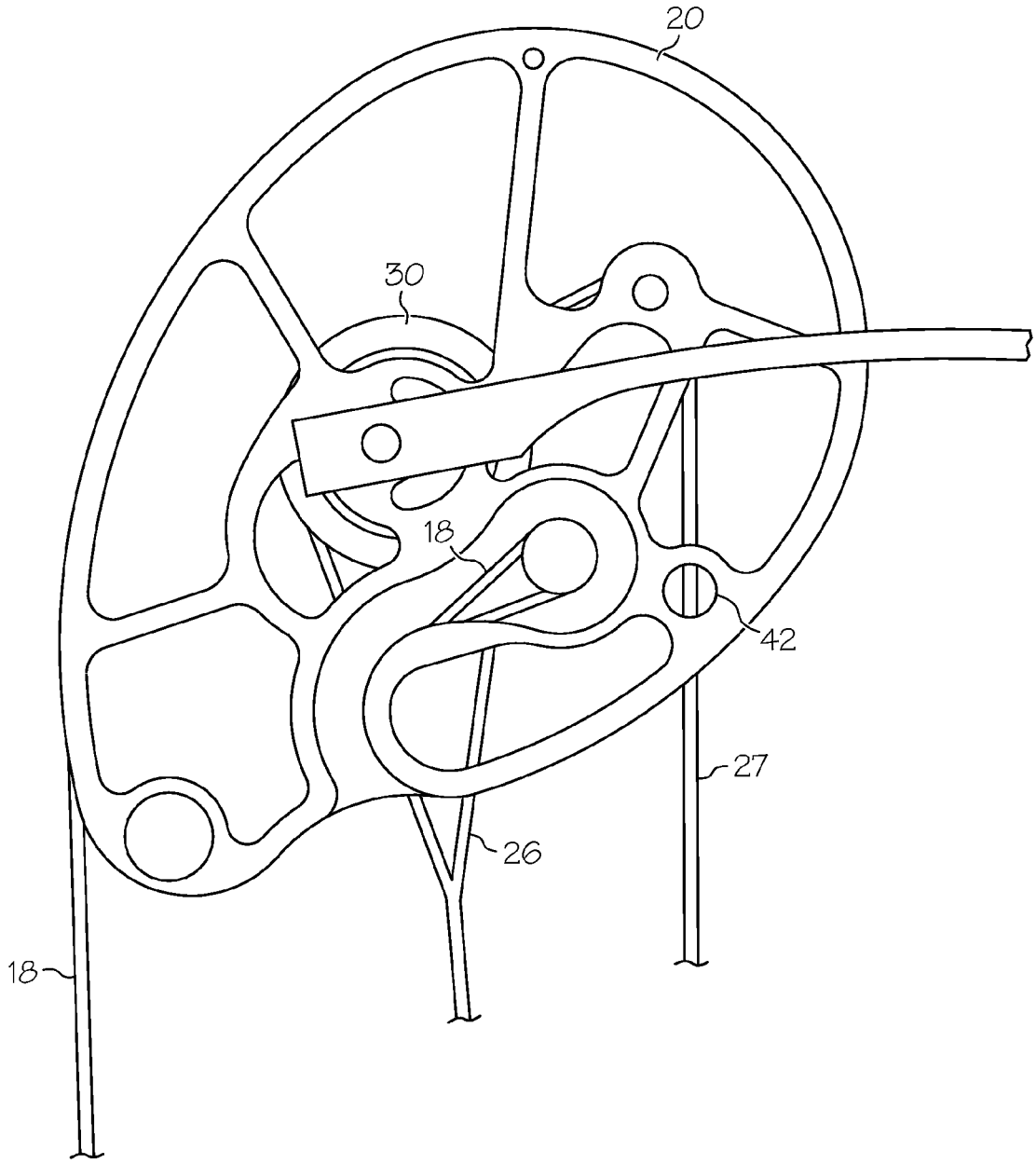
FIG. 29 shows a rotatable member of FIG. 28 in greater detail.

FIG. 29 shows the upper rotatable member 20 of FIG. 28 in greater detail.

Figure 30:
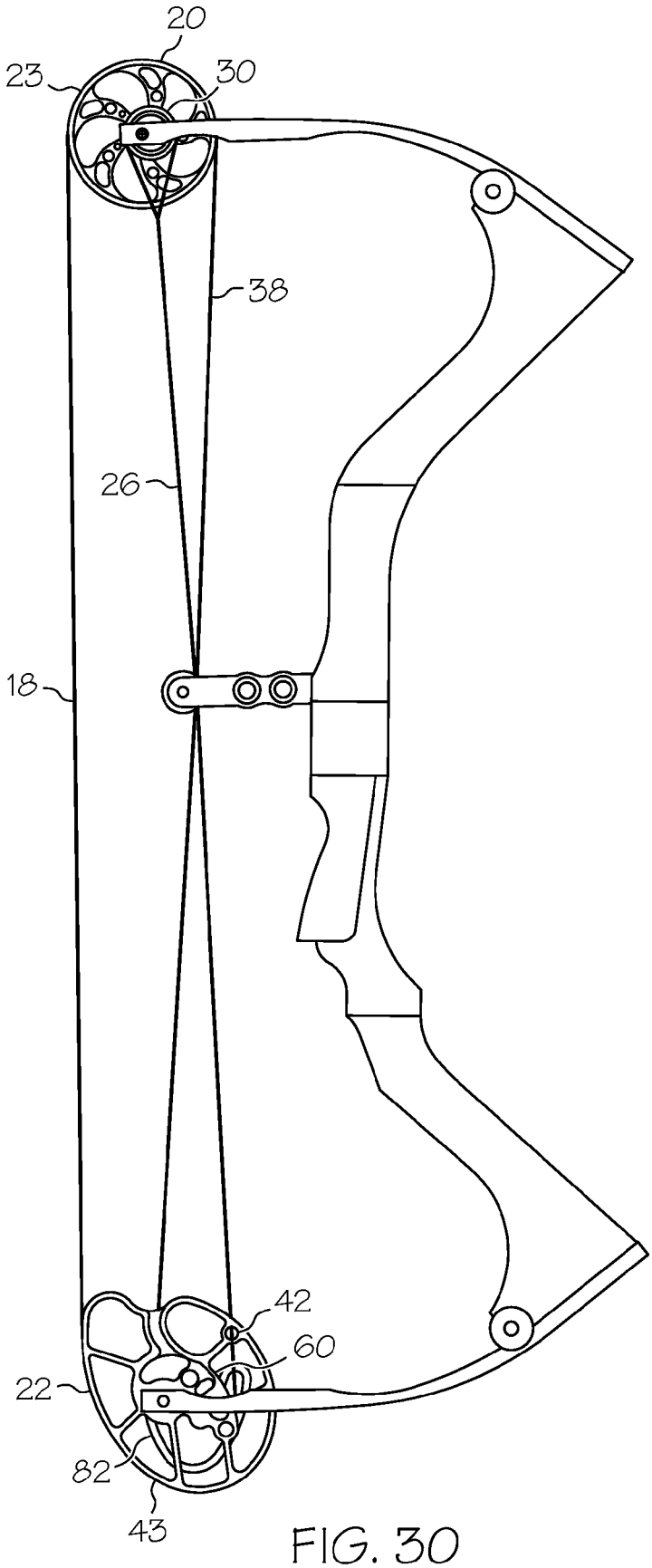
FIG. 30 shows an embodiment of a single cam archery bow comprising a vectoring anchor.

FIG. 30 shows another embodiment of a bow 10 comprising a vectoring anchor 30, wherein the bow 10 comprises a single cam bow. As such, one rotatable member 22 comprises a cam 43 and the other rotatable member 20 comprises a pulley 23. A cable comprises a bowstring portion 18 and a second portion 38, wherein the bowstring portion 18 is anchored to the cam 43 and extends upward around a portion of the pulley 23 and terminates at the pulley 23. The second portion 38 of the cable engages a portion of a take-up track on the pulley 23 prior to extending downwardly from the pulley 23 and attaching to the cam 43. The second portion 38 can comprise a control cable and can be oriented in a payout track 82. In some embodiments, a pulley 23 comprises a vectoring anchor 30. A power cable 26 can be anchored at one end to the vectoring anchor 30, and can be anchored at the other end to the cam 43 proximate to a take-up track 60.

Figure 31:
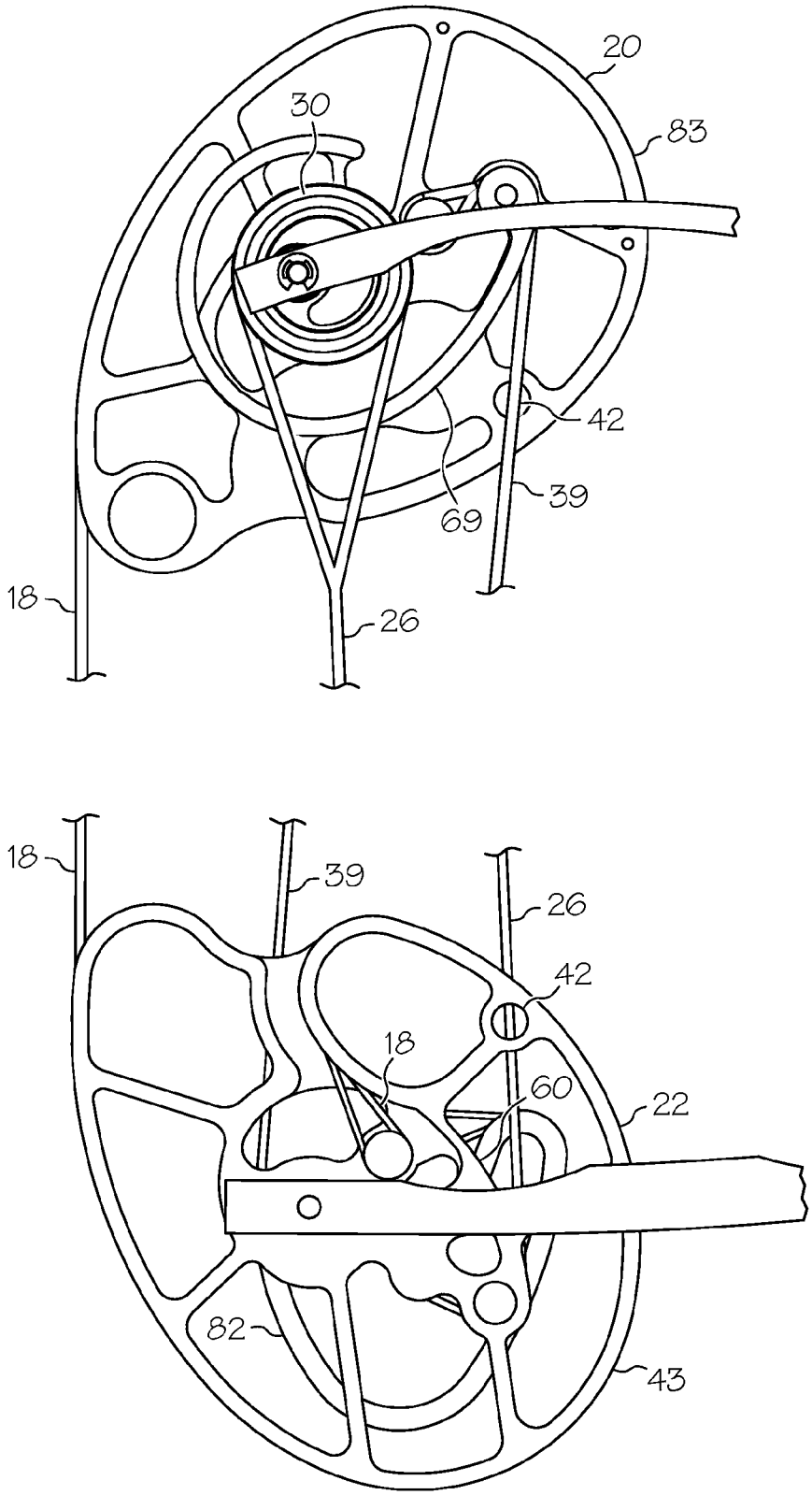
FIG. 31 shows an embodiment of rotatable members suitable for use in a 1.5 cam bow.

FIG. 31 shows a further embodiment rotatable members 20, 22 suitable for use in a bow 10 comprising a vectoring anchor 30, wherein the bow 10 comprises what is known in the industry as a 1.5 cam or hybrid cam bow. Example of 1.5 cam style bows are described, for example, in U.S. Pat. Nos. 5,934,265 and 6,082,347, the entire disclosures of which are hereby incorporated herein by reference in their entireties. One rotatable member 22 comprises a cam 43 and the other rotatable member 20 comprises a modified pulley or hybrid cam 83. In some embodiments, the cam 43 can be similar to the cam 43 of FIG. 30.

A bowstring 18 is anchored to the cam 43 at one end and is anchored to the hybrid cam 83 at the other end. Each end can be oriented in a payout track included on the cam 43 or hybrid cam 83. A control cable 39 can be attached at one end to the hybrid cam 83 proximate to a take-up track 69, and can be attached at the other end to the cam 43 and oriented in a payout track 82. In some embodiments, a hybrid cam 83 comprises a vectoring anchor 30. A power cable 26 can be anchored at one end to the vectoring anchor 30, and can be anchored at the other end to the cam 43 proximate to a take-up track 60. In some embodiments, a hybrid cam 83 comprises a timing window 42, and a portion of the control cable 39 can be visible through the timing window 42. The cam 43 can also comprise a timing window 42, wherein a portion of the power cable 26 can be visible through the timing window 42.

Figure 32:
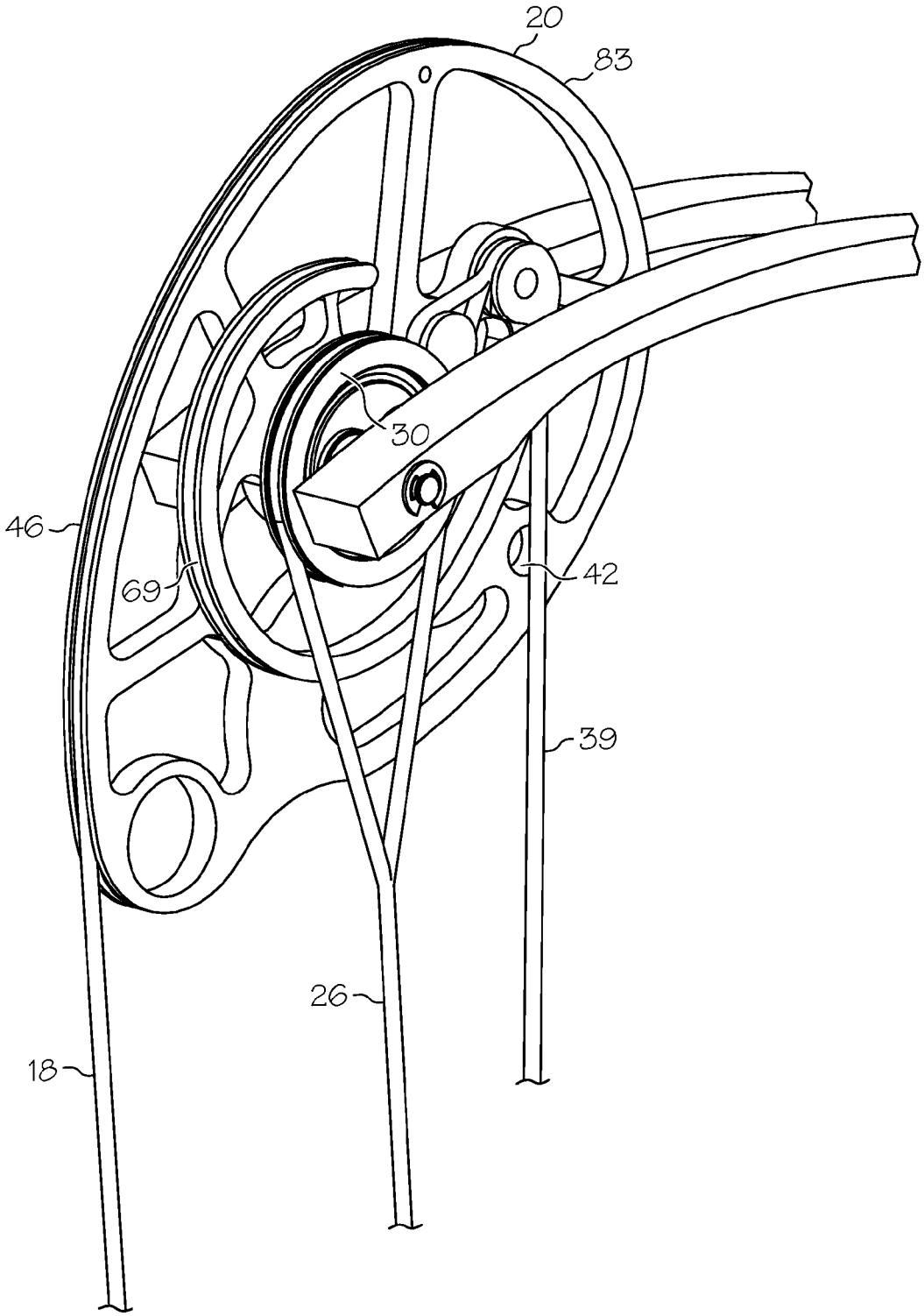
FIG. 32 shows an embodiment of a modified pulley or hybrid cam comprising a vectoring anchor.

FIG. 32 shows the modified pulley/hybrid cam 83 of FIG. 31 in greater detail.

Figure 33:
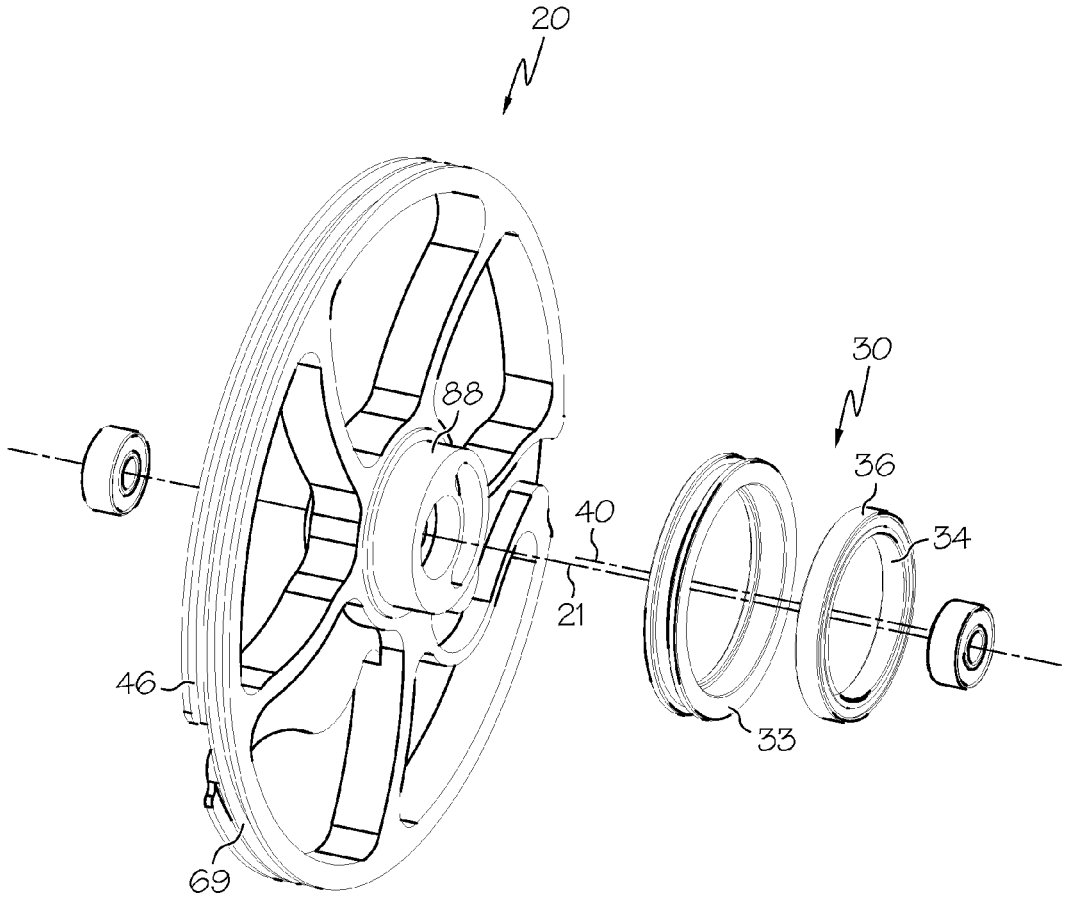
FIG. 33 shows another embodiment of a rotatable member comprising a vectoring anchor.

FIG. 33 shows another embodiment of a rotatable member 20 comprising a vectoring anchor 30. The rotatable member 20 comprises a first track 46 about its outer periphery. The first track 46 can comprise a bowstring payout track. The rotatable member further comprises a second track 69 about its outer periphery. The second track 69 can comprise a cable take-up track, such as a control cable take-up track. In some embodiments, the first track 46 and second track 69 can be concentric, for example being centered upon the rotatable member axis 21.

The rotatable member 20 can further comprise a hub 88 that engages the vectoring anchor 30.

Figure 34:
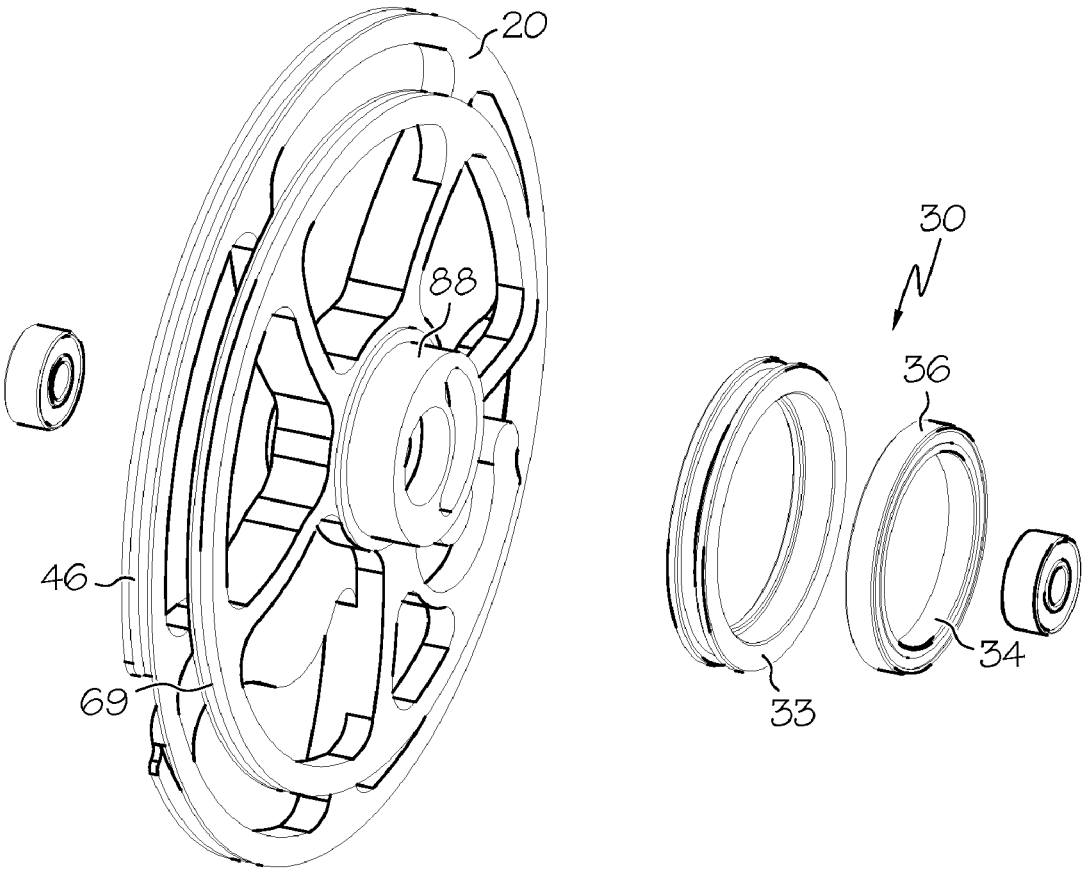
FIG. 34 shows another embodiment of a rotatable member comprising a vectoring anchor.

FIG. 34 shows another embodiment of a rotatable member 20 comprising a vectoring anchor 30. The rotatable member 20 comprises a first track 46 about its outer periphery. The first track 46 can comprise a bowstring payout track. The rotatable member further comprises a second track 69. The second track 69 can comprise a cable take-up track, such as a control cable take-up track. In some embodiments, the first track 46 and second track 69 can be concentric, for example being centered upon the rotatable member axis 21. The second track 69 can define a radius that is different from that of the first track 46. For example, as shown in FIG. 34, the second track 69 can have a smaller radius.

In various embodiments, the second track 69 can have a length that is less than, equal to or greater than the length of the first track 46.

In some embodiments, the first track 46 and second track 69 can be concentric with one another, wherein their center is offset from the rotatable member axis 21.

In some embodiments, the first track 46 and second track 69 can each define eccentric paths, which can be different from one another. Various configurations of the first track 46 and second track 69, when used in a bow with a cam 43, can allow for a bow 10 that exhibits a nock point that travels in a straight line, for example as discussed in U.S. Pat. Nos. 5,505,185 and 6,666,202, the entire disclosures of which are hereby incorporated herein by reference in their entireties.

In some embodiments, a rotatable member 20 can be described according to the following numbered paragraphs.

1. A rotatable member for use with a compound archery bow comprising:
   a body configured for rotation about a rotatable member axis; and
   a cable anchor attached to said body and rotatable with respect to said body about an anchor axis, said anchor axis offset from said rotatable member axis.
2. The rotatable member of paragraph 1, wherein said cable anchor comprises a first portion rotatable with respect to a second portion, said first portion fixedly attached to said body.
3. The rotatable member of paragraph 2, wherein said second portion comprises an extension member.
4. The rotatable member of paragraph 3, wherein said extension member comprises an anchoring mechanism offset from said anchor axis, said anchoring mechanism configured for anchoring a cable thereto.
5. The rotatable member of paragraph 4, wherein said extension member is symmetrical across a line extending between a center of said anchoring mechanism and said anchor axis.
6. The rotatable member of paragraph 2, wherein said first portion comprises a post.
7. The rotatable member of paragraph 2, wherein said second portion comprises a sheave.
8. The rotatable member of paragraph 1, wherein said cable anchor comprises a rolling element bearing.

9. The rotatable member of paragraph 1, wherein said cable anchor comprises a bearing that defines a circumference.
10. The rotatable member of paragraph 9, wherein said rotatable member axis is oriented within said circumference.
11. The rotatable member of paragraph 1, wherein said first rotatable member axis is parallel to said anchor axis.
12. The rotatable member of paragraph 1, further comprising a second cable anchor, said second cable anchor attached to said body and rotatable with respect to said body about said anchor axis.
13. The rotatable member of paragraph 12, wherein said cable anchor and said second cable anchor are located on opposite sides of said body.
14. The rotatable member of paragraph 12, wherein said second cable anchor comprises a first portion rotatable with respect to a second portion, said first portion fixedly attached to said body.
15. The rotatable member of paragraph 14, wherein said second portion comprises a sheave.
16. The rotatable member of paragraph 12, wherein said second cable anchor comprises a rolling element bearing.
17. The rotatable member of paragraph 1, further comprising a bowstring payout track.
18. The rotatable member of paragraph 17, wherein said bowstring payout track defines a curve about said rotatable member axis, said curve having a constant radius.
19. The rotatable member of paragraph 17, wherein said bowstring payout track defines a curve that extends eccentrically about said rotatable member axis.
20. The rotatable member of paragraph 17, further comprising a cable take-up track.
21. The rotatable member of paragraph 20, wherein said cable take-up track defines a curve about said rotatable member axis, said curve having a constant radius.
22. The rotatable member of paragraph 20, wherein said cable take-up track defines a curve that extends eccentrically about said rotatable member axis.
23. The rotatable member of paragraph 20, wherein said cable take-up track comprises a power let-off cam track.
24. The rotatable member of paragraph 20, wherein said cable take-up track is concentric with said bowstring payout track.
25. The rotatable member of paragraph 24, wherein a radius of said cable take-up track is different from a radius of said bowstring payout track.
26. The rotatable member of paragraph 1, wherein said rotatable member comprises a cam.
27. The rotatable member of paragraph 1, wherein said rotatable member comprises a pulley.
28. The rotatable member of paragraph 1, further comprising a module, the module comprising a cable take-up track.
29. The rotatable member of paragraph 28, wherein said module comprises a power let-off cam.
30. The rotatable member of paragraph 28, wherein said module is attached to said rotatable member with a fastener.
31. The rotatable member of paragraph 28, wherein said module is adjustable with respect to said rotatable member.
32. The rotatable member of paragraph 31, wherein said module is rotatable about said rotatable member axis.
33. The rotatable member of paragraph 31, said rotatable member comprising a fastener receiving portion, said module comprising a plurality of fastener apertures.
34. The rotatable member of paragraph 28, comprising a plurality of interchangeable modules, wherein each module comprises a fastener aperture and a cable take-up track, an orientation of said cable take-up track with respect to said fastener aperture being different for each module.
35. A rotatable member for use with a compound archery bow comprising:
   a body configured for rotation about a rotatable member axis; and
   a module configured for attachment to said body, said module comprising a cable anchor rotatable with respect to said module about an anchor axis, said anchor axis offset from said rotatable member axis.
36. The rotatable member of paragraph 35, wherein said module comprises a cable take-up track.
37. The rotatable member of paragraph 36, further comprising a post attached to said body, said post comprising a groove, said groove and said cable take-up track oriented on a common plane.
38. The rotatable member of paragraph 36, wherein said module is rotatable with respect to said body about said rotatable member axis.
39. The rotatable member of paragraph 38, wherein said module is configured for attachment to said body at a plurality of rotational orientations.
40. The rotatable member of paragraph 38, wherein when said module is rotated with respect to said body, the location of said anchor axis moves with respect to said rotatable member axis.
41. The rotatable member of paragraph 36, said body comprising a fastener receiving portion, said module comprising a plurality of fastener apertures.
42. The rotatable member of paragraph 35, wherein said cable anchor comprises a first portion rotatable with respect to a second portion, said first portion fixedly attached to said module.
43. The rotatable member of paragraph 42, wherein said second portion comprises a plate.
44. The rotatable member of paragraph 35, wherein said cable anchor comprises a rolling element bearing.
45. The rotatable member of paragraph 35, wherein said cable anchor comprises a bearing that defines a circumference.
46. The rotatable member of paragraph 45, wherein said rotatable member axis is oriented within said circumference.
47. The rotatable member of paragraph 35, wherein said first rotatable member axis is parallel to said anchor axis.
48. The rotatable member of paragraph 35, further comprising a bowstring payout track.
49. An archery bow comprising:
   a rotatable member rotatable about a rotatable member axis, the rotatable member comprising a power cable anchor defining an anchor axis, the anchor axis offset from the rotatable member axis; and
   a power cable anchored to said power cable anchor, the power cable rotatable with respect to said first rotatable member about said anchor axis.
50. The archery bow of paragraph 49, wherein a body portion of the rotatable member comprises a first material and the power cable anchor comprises a second material, the second material having a lower coefficient of friction than the first material.
51. The archery bow of paragraph 49, wherein said power cable anchor comprises a thermoplastic.

52. The archery bow of paragraph 49, wherein said power cable anchor comprises polytetrafluoroethylene.
53. The archery bow of paragraph 49, wherein said power cable anchor comprises a sheave.
54. The archery bow of paragraph 53, wherein said rotatable member axis is located within an area defined by said sheave.
55. The archery bow of paragraph 49, wherein said power cable anchor comprises an extension member.
56. The archery bow of paragraph 55, wherein said extension member comprises a post.
57. The archery bow of paragraph 55, wherein said extension member extends outwardly on opposite sides of said rotatable member.
58. The archery bow of paragraph 49, wherein said power cable applies a moment to said rotatable member about said rotatable member axis in a first direction when the bow is oriented in a brace condition, and said power cable applies a moment to said rotatable member about said rotatable member axis in a second direction when the bow is oriented in a drawn condition.
59. The archery bow of paragraph 49, wherein a bowstring and said anchor axis are located on opposite sides of said rotatable member axis when the bow is oriented in a brace condition, and said bowstring and said anchor axis are located to a common side of said rotatable member axis when the bow is oriented in a drawn condition.
60. The archery bow of paragraph 49, wherein said rotatable member axis is parallel to said anchor axis.
61. The archery bow of paragraph 49, the rotatable member further comprising a second power cable anchor and a second power cable take-up track, the second power cable take-up track extending eccentrically about said rotatable member axis.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a first rotatable member supported by the bow, the first rotatable member being rotatable about a first rotatable member axis;

a first power cable anchor, said first power cable anchor attached to said first rotatable member and rotatable with respect to said first rotatable member about a first anchor axis via a circular bearing that defines a circumference, said first rotatable member axis oriented within said circumference, said first anchor axis offset from said first rotatable member axis; and a first power cable anchored to said first power cable anchor;

wherein said first power cable anchor comprises a first portion and a second portion, the first portion rotatable with respect to said second portion, the first portion attached to said first rotatable member, the second portion comprising a groove around its outer periphery, a portion of said power cable oriented in said groove.

2. The archery bow of claim 1, wherein said second portion comprises a sheave.

3. The archery bow of claim 1, wherein said circular bearing comprises a rolling element bearing.

4. The archery bow of claim 1, further comprising a second rotatable member, the second rotatable member being rotatable about a second rotatable member axis.

5. The archery bow of claim 4, wherein said first power cable is anchored to said second rotatable member.

6. The archery bow of claim 5, wherein said second rotatable member comprises a first power cable take-up track, and the first power cable is taken up on said first power cable take-up track as the bow is drawn.

7. The archery bow of claim 6, further comprising a second power cable anchor and a second power cable, said second power cable anchor attached to said second rotatable member and rotatable with respect to said second rotatable member about a second anchor axis, said second anchor axis offset from said second rotatable member axis, said second power cable anchored to said second power cable anchor.

8. The archery bow of claim 7, wherein said second power cable is anchored to said first rotatable member, said first rotatable member comprises a second power cable take-up track, and the second power cable is taken up on said second power cable take-up track as the bow is drawn.

9. The archery bow of claim 8, wherein said first power cable anchor comprises a mirror image of said second power cable anchor.

10. The archery bow of claim 9, wherein said first rotatable member comprises a mirror image of said second rotatable member.

11. The archery bow of claim 1, wherein said first power cable applies a moment to said first rotatable member about said first rotatable member axis in a first direction when the bow is oriented in a brace condition, and said first power cable applies a moment to said first rotatable member about said first rotatable member axis in a second direction when the bow is oriented in a drawn condition.

12. The archery bow of claim 1, wherein a bowstring and said first anchor axis are located on opposite sides of said first rotatable member axis when the bow is oriented in a brace condition, and said bowstring and said first anchor axis are located to a common side of said first rotatable member axis when the bow is oriented in a drawn condition.

13. The archery bow of claim 1, wherein said first power cable terminates on said circular bearing.

14. The archery bow of claim 1, wherein said first rotatable member axis is parallel to said first anchor axis.

15. The archery bow of claim 1, further comprising a second power cable anchor, said second power cable anchor attached to said first rotatable member and rotatable with respect to said first rotatable member about said first anchor axis, said first power cable further comprising a second portion anchored to said second power cable anchor.

16. The archery bow of claim 15, wherein said second power cable anchor comprises a circular bearing that defines a second circumference, said first rotatable member axis oriented within said second circumference.

17. An archery bow comprising:

a first rotatable member supported by the bow, the first rotatable member being rotatable about a first rotatable member axis;

a first power cable anchor, said first power cable anchor attached to said first rotatable member and rotatable with respect to said first rotatable member about a first anchor axis via a circular bearing that defines a circumference, said first rotatable member axis oriented with said circumference, said first anchor axis offset from said first rotatable member axis; and a first power cable anchored to said first power cable anchor;

wherein said first power cable anchor comprises a first portion and a second portion, the first portion rotatable with respect to said second portion, the first portion attached to said first rotatable member, said second portion comprising an extension member, said power cable anchored to said extension member.

18. The archery bow of claim 17, wherein said extension member comprises an anchoring mechanism offset from said first anchor axis, said first power cable anchored to said anchoring mechanism.

19. The archery bow of claim 18, wherein said extension member is symmetrical across a line extending between a center of said anchoring mechanism and said first anchor axis.

20. An archery bow having an undrawn orientation and a drawn orientation, the archery bow comprising:

a rotatable member rotatable about a rotatable member supported by the bow axis, said rotatable member comprising a rotatable sheave, said rotatable sheave said rotatable member axis;

a power cable attached to the rotatable sheave; and a bowstring attached to the rotatable member;

wherein the power cable and bowstring apply counteracting moments to the rotatable member in the undrawn orientation, and the power cable and bowstring apply cooperative moments to the rotatable member in the drawn orientation.

21. The archery bow of claim 20, wherein a force vector applied to the rotatable member by the power cable transitions across the rotatable member axis as the archery bow transitions from the undrawn orientation to the drawn orientation.

* * * * *

UNITED STATES PATENT AND TRADEMARK OFFICE

CERTIFICATE OF CORRECTION

PATENT NO. : 8,020,544 B2
APPLICATION NO. : 12/248467
DATED : September 20, 2011
INVENTOR(S) : Mathew A. McPherson and Gary L. Simonds It is certified that error appears in the above-identified patent and that said Letters Patent is hereby corrected as shown below:

Claim 20, at column 22, lines 13 and 14, the text "a rotatable member rotatable about a rotatable member supported by the bow axis" should be replaced by the text --a rotatable member supported by the bow, rotatable about a rotatable member axis--.

Claim 20, at column 22, lines 15 and 16, the text "said rotatable sheave said rotatable member axis" should be replaced by the text --said rotatable sheave surrounding said rotatable member axis--.

Signed and Sealed this
Fifteenth Day of January, 2013

David J. Kappos

David J. Kappos
*Director of the United States Patent and Trademark Office*